US011453573B2

(12) United States Patent
Kashiwakura

(10) Patent No.: US 11,453,573 B2
(45) Date of Patent: Sep. 27, 2022

(54) ELEVATOR DOOR ENGAGEMENT DEVICE

(71) Applicant: FUJITEC CO., LTD., Hikone (JP)

(72) Inventor: Hiroshi Kashiwakura, Hikone (JP)

(73) Assignee: FUJITEC CO., LTD., Shiga (JP)

( * ) Notice: Subject to any disclaimer, the term of this patent is extended or adjusted under 35 U.S.C. 154(b) by 85 days.

(21) Appl. No.: 17/187,990

(22) Filed: Mar. 1, 2021

(65) Prior Publication Data

US 2021/0276830 A1 Sep. 9, 2021

(30) Foreign Application Priority Data

Mar. 3, 2020 (JP) ..... JP2020-036039
Dec. 15, 2020 (JP) ..... JP2020-207539

(51) Int. Cl.
*B66B 13/12* (2006.01)
*B66B 13/16* (2006.01)

(52) U.S. Cl.
CPC ..... *B66B 13/12* (2013.01); *B66B 13/16* (2013.01)

(58) Field of Classification Search
CPC ..... B66B 13/12; B66B 13/16; B66B 13/20
See application file for complete search history.

(56) References Cited

U.S. PATENT DOCUMENTS

| | | | |
|---|---|---|---|
| 5,690,188 | A | 11/1997 | Takakusaki et al. |
| 6,446,759 | B1 | 9/2002 | Kulak et al. |
| 2002/0056594 | A1 | 5/2002 | Fahl et al. |
| 2007/0295564 | A1 | 12/2007 | Someya |
| 2013/0048433 | A1 | 2/2013 | Tantis |
| 2021/0009383 | A1 | 1/2021 | Kashiwakura |

FOREIGN PATENT DOCUMENTS

| | | | | |
|---|---|---|---|---|
| CN | 104760871 | A | * 7/2015 | |
| CN | 105438941 | A | * 3/2016 | |
| JP | H8245143 | A | 9/1996 | |
| JP | 2002179369 | A | 6/2002 | |
| JP | 2006290566 | A | 10/2006 | |
| JP | 2011148635 | A | 8/2011 | |
| JP | 2013526470 | A | 6/2013 | |
| JP | 6751534 | B1 | 9/2020 | |
| WO | 2005123562 | A1 | 12/2005 | |
| WO | WO-2015008386 | A1 | * 1/2015 | ..... B66B 13/12 |
| WO | WO-2018138896 | A1 | * 8/2018 | ..... B66B 13/12 |
| WO | 2020179911 | A1 | 2/2020 | |

* cited by examiner

*Primary Examiner* — Diem M Tran
(74) *Attorney, Agent, or Firm* — The Webb Law Firm

(57) ABSTRACT

Provided is an elevator door engagement device including a first member and a second member extending in a vertical direction; at least one of a first link member and a second link member, the first link member constituting together with the first member a parallel link mechanism, the second link member constituting together with the second member a parallel link mechanism; a first roller arranged in the first member; and a second roller arranged in the second member.

12 Claims, 19 Drawing Sheets

ELEVATOR DOOR ENGAGEMENT DEVICE

CROSS-REFERENCE TO RELATED APPLICATION

This application claims priority to Japanese Patent Application No. 2020-036039 filed Mar. 3, 2020 and Japanese Patent Application No. 2020-207539 filed Dec. 15, 2020, the disclosures of which are hereby incorporated by reference in their entirety.

BACKGROUND OF THE INVENTION

Field of the Invention

The present invention relates to an elevator door engagement device configured to, when a car door or a landing door opens and closes, engage with an engaged part provided in a door facing the car door or the landing door.

Description of Related Art

A landing door of an elevator is configured to engage with a car door to be opened and closed when a car lands on a landing floor to allow a door opening and closing device (driving device) installed in a car body of the car to open and close the car door. The landing door is provided with a landing side locking mechanism to prevent the landing door from opening in the state where the car does not land on the landing floor. The landing side locking mechanism is switched from a locked state to an unlocked state when the car door starts opening. Thereby, the opening of the landing door is enabled. The unlocking operation by the landing side locking mechanism is performed by utilizing the driving force of the door opening and closing device installed in the car body via a door engagement device that is installed in the car door to open and close the door.

There have been mainly known a belt driven type device and a swing arm type device as the door opening and closing device to be installed in the car body. Among them, the door opening and closing device of the swing arm type is disclosed, for example, in the patent literature, JP H8-245143. Specifically, as shown in FIG. 18, a door opening and closing device 900 of the swing arm type includes a swing arm 902 (referred to as a link in the patent literature) pivotally supported by a shaft 901 arranged above the car body. The door opening and closing device 900 is configured to allow the swing arm 902 to swing around the shaft 901 to thereby open and close the door 903 connected to a lower part of the swing arm 902.

Further, a door engagement device (mechanism for releasing a locking state) 910 for opening and closing the door provided in addition to the door opening and closing device 900 of the swing arm type includes a pair of rollers 911 arranged away from each other in the horizontal direction, a plurality of links 912 supporting the pair of rollers 911 while being pivotally supported by the car door, and a cam 913 for swinging the links 912.

On the other hand, as shown in, for example, FIG. 19, a door engagement device 920 (hereinafter also referred to as an engaged part) for opening and closing the door, which corresponds to the door opening and closing device 900 of the swing arm type, includes, for example, a pair of links 921, 921 arranged away from each other in the vertical direction while being pivotally supported by the landing door, an unlock plate 922 supported by the links 921, 921 and extending in the vertical direction, and an engaging plate 923 fixed to the landing door. Further, a landing side locking mechanism 930 includes a latch 931 pivotally supported by a shaft 931*a* arranged above the landing door, a latch receiver 932 configured to engage with the latch 931 and arranged above a landing side entrance opening, and a tension spring 933 configured to bias the latch 931 toward the latch receiver 932. One of the pair of links 921, 921 (the link arranged on the upper side in FIG. 19) is connected to the latch 931 via a rod 940.

The pair of rollers 911 are held by the cam 913 with a certain distance from each other in a door closed state. When the car lands on a desired landing floor, the unlock plate 922 and the engaging plate 923 provided in the landing door are located between the pair of rollers 911. When the swing arm 902 starts to swing for opening the car door, the swing arm 902 causes the link 912 to swing via the cam 913. Thereby, the pair of rollers 911 move so as to make the distance therebetween narrower, and clamp the unlock plate 922 and the engaging plate 923. As a result, the link 921 swings to cause the rod 940 that is connected to the link 921 to be pulled downward and accordingly cause the connecting portion of the latch 931 with the rod 940 to be pulled downward, so that the latch 931 pivotally moves around the shaft 931*a* to bring the latch 931 and the latch receiver 932 out of the engagement with each other. Thereby, the locking state of the landing side locking mechanism 930 is released.

As described above, the locking mechanism of the landing door, which corresponds to the conventional door opening and closing device of the swing arm type, needs to lock or unlock by the actuation of the rollers via the cam and the link mechanism that are operated in association with the swing motion of the swing arm. For this reason, the door opening and closing device of the swing arm type could not be replaced with a door opening and closing device equipped with no swing arm. Therefore, in the elevator renewal construction for an elevator including a landing door provided with a locking mechanism corresponding to the door opening and closing device of the swing arm type, a car using the door opening and closing device equipped with no swing arm could not be installed, which caused a problem that the renewal according to the user's needs cannot be accomplished.

SUMMARY OF THE INVENTION

It is an object of the present invention to provide an elevator door engagement device capable of locking and unlocking a locking mechanism of a car door or a landing door provided to correspond to a door opening and closing device of the swing arm type, even in the case where a door opening and closing device equipped with no swing arm is adopted for renewal.

For improving the basic understanding on the some features of the invention of the present application, a brief summary of the present invention will be described below. This summary does not show the outline of the present invention, and is not intended to specify the main or important features of the present invention or to limit the scope of the present invention. The purpose thereof is only to provide some of basic concepts of the invention in a simplified style as a premise of the subsequent detailed description of the invention.

An elevator door engagement device provided in one of a car door and a landing door and configured to engage with an engaged part provided in the remaining one of the landing door and the car door, to transmit driving force to open and close the one of the car door and the landing door to the remaining one of the landing door and the car door, the engagement device including:

a first member extending in a vertical direction;

a second member extending in the vertical direction and arranged at a position with a distance from the first member to be closer to a door closing side than the first member;

at least one of a first link member and a second link member, the first link member constituting together with the first member a parallel link mechanism configured to enable the first member to be pivotally movable between a first position that is a given position and a second position that is a position closer to the door closing side than the first position while the posture of the first member to the second member is maintained, the second link member constituting together with the second member a parallel link mechanism configured to enable the second member to be pivotally movable between a third position that is a given position and a forth position that is a position closer to a door opening side than the third position while the posture of the second member to the first member is maintained;

a first roller arranged in the first member to have its circumference facing the engaged part when the car lands on a given landing floor; and a second roller arranged in the second member to have its circumference facing the engaged part when the car lands on the given landing floor.

The elevator door engagement device may be configured such that the first link member includes a pair of first link elements, and the first roller is arranged between the pair of first link elements as viewed from a lateral side of the car door or the landing door.

The elevator door engagement device may be configured such that the second link member includes a pair of second link elements, and the second roller is arranged between the pair of second link elements as viewed from a lateral side of the car door or the landing door.

The elevator door engagement device may be configured such that the first member is operably connected to a cam mechanism provided above an entrance on a car side or a landing floor side to allow the cam mechanism to hold the first member at the first position in a door closed state and hold the first member at the second position when the car door or the landing door has moved from the door closed state in a door opening direction.

The elevator door engagement device may be configured such that the second member is operably connected to a locking mechanism configured to lock or unlock the car door or the landing door in the door closed state, and unlocks the locking mechanism when the second member moves from the fourth position to the third position.

The elevator door engagement device may further include an engaging part including the first roller and the second roller configured to come into clamping engagement with the engaged part and release the clamping engagement by movement of the first roller and the second roller toward and away from each other in the opening and closing direction of the car door or the landing door in association with movement of the first member and the second member toward and away from each other, the engaging part being configured to be able to adjust the position in the opening and closing direction of at least one of the first roller and the second roller, at which position the engaged part is clamped by the first roller and the second roller.

The elevator door engagement device may be configured such that the engaging part includes a roller support part that is mounted to one of the first member and the second member and configured to support the one of the first roller and the second roller, the roller support part includes a plate section that extends outward in the vertical direction and the opening and closing direction and is provided with an elongated hole extending in a direction including a component in the opening and closing direction, and the one of the first roller and the second roller includes an insertion section passing through the elongated hole to be movable along the elongated hole.

In the elevator door engagement device, the elongated hole may extend in a direction inclined to the opening and closing direction.

The elevator door engagement device may be configured such that the plate section includes a hole peripheral section of the elongated hole, the elongated hole being defined by a pair of edges and extending in the inclined direction in parallel to each other, and the insertion section includes a pair of sliding surfaces respectively extending along the pair of edges to be slidable with respect to the pair of edges.

The elevator door engagement device may be configured such that the one of the first roller and the second roller includes a shaft extending in an entrance direction of the car, and a roller body rotatable around the shaft, and the insert section is constituted by a part of the shaft.

In the elevator door engagement device, the one of the first roller and the second roller may include a flange extending outward from one end in an insertion direction of the insertion section along the hole peripheral section of the elongated hole.

The elevator door engagement device may be configured such that the insertion section includes a male screw extending directly or indirectly from the flange, the one of the first roller and the second roller includes a nut configured to be brought into threaded engagement with the male screw to hold the hole peripheral section between the flange and the nut, and the plate section is arranged at a position at which a distance between a distal end of the insertion section and one of the first member and the second member is smaller than a dimension in the insertion direction of the nut.

BRIEF DESCRIPTION OF THE DRAWINGS

The aforementioned features and the other features of the present invention will be clarified by the following description and figures illustrating the embodiments of the present invention.

DESCRIPTION OF THE INVENTION

Hereinafter, an embodiment of the present invention will be described with reference to FIG. 1 to FIG. 12.

Figure 1:
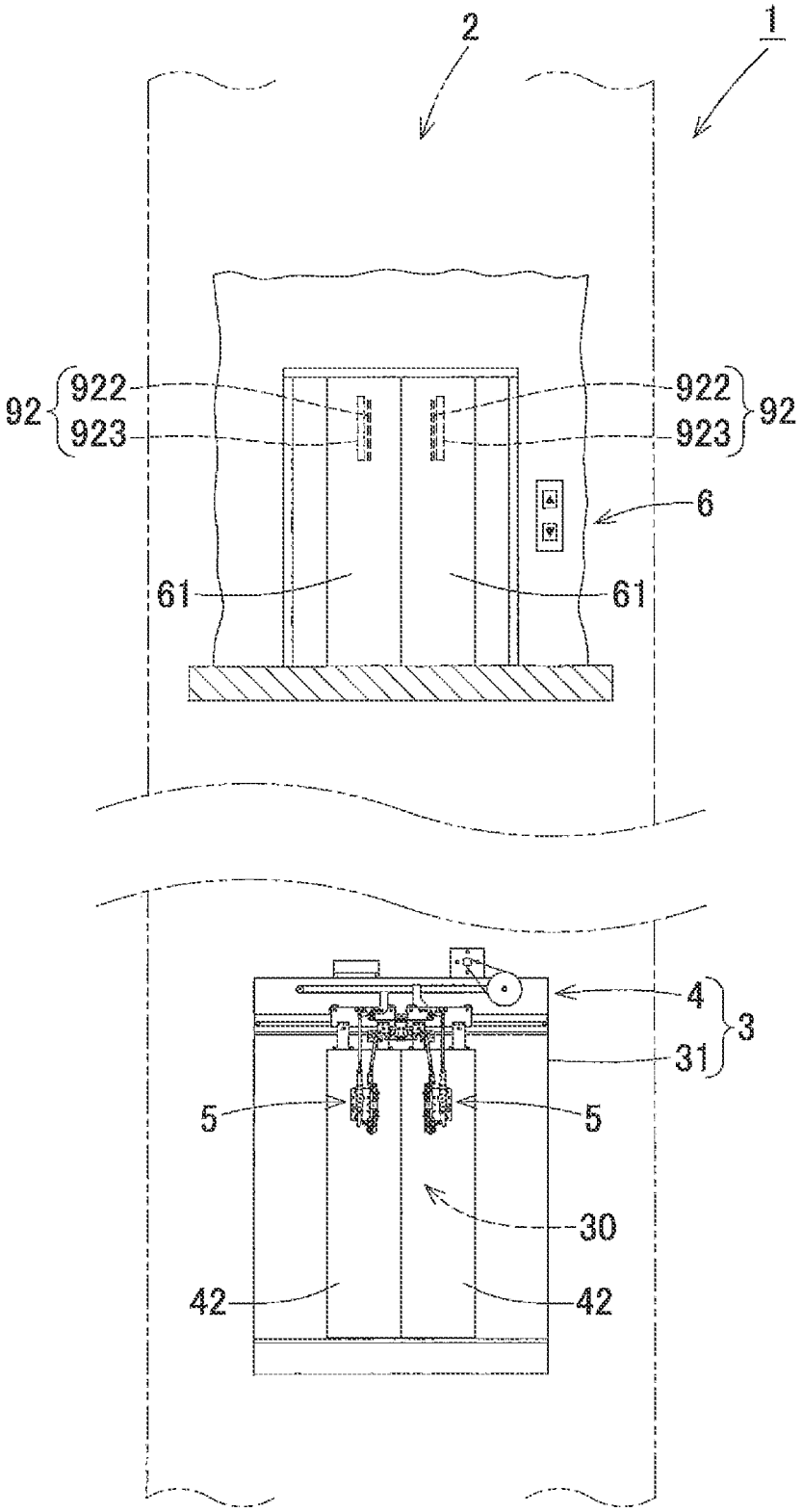
FIG. 1 is a schematic diagram showing a configuration of an elevator according to a first embodiment.

As shown in FIG. 1, in an elevator 1 including an elevator shaft 2 that extends in the vertical direction throughout a plurality of floors in a building, and a car 3 that is raised or lowered within the elevator shaft 2, an engagement device 5 for a door of an elevator according to this embodiment is arranged in a car door (door) 42 of a door device 4 that opens and closes an entrance opening (car side entrance opening) 30 provided in the car 3. The door engagement device 5 is configured to engage with an engaged part 92 arranged in a landing door 61 (i.e. the opposite door) when the car 3 lands on a desired landing floor 6, to thereby make the landing door 61 follow the motion of the car door 42 when the car door 42 opens and closes.

The car 3 includes a car body 31 having the entrance opening 30, and a door device 4 having the car door 42 and arranged in the car body 31. The engagement device 5 is arranged in the car door 42 of the door device 4. That is, the door device 4 includes the engagement device 5.

Figure 2:
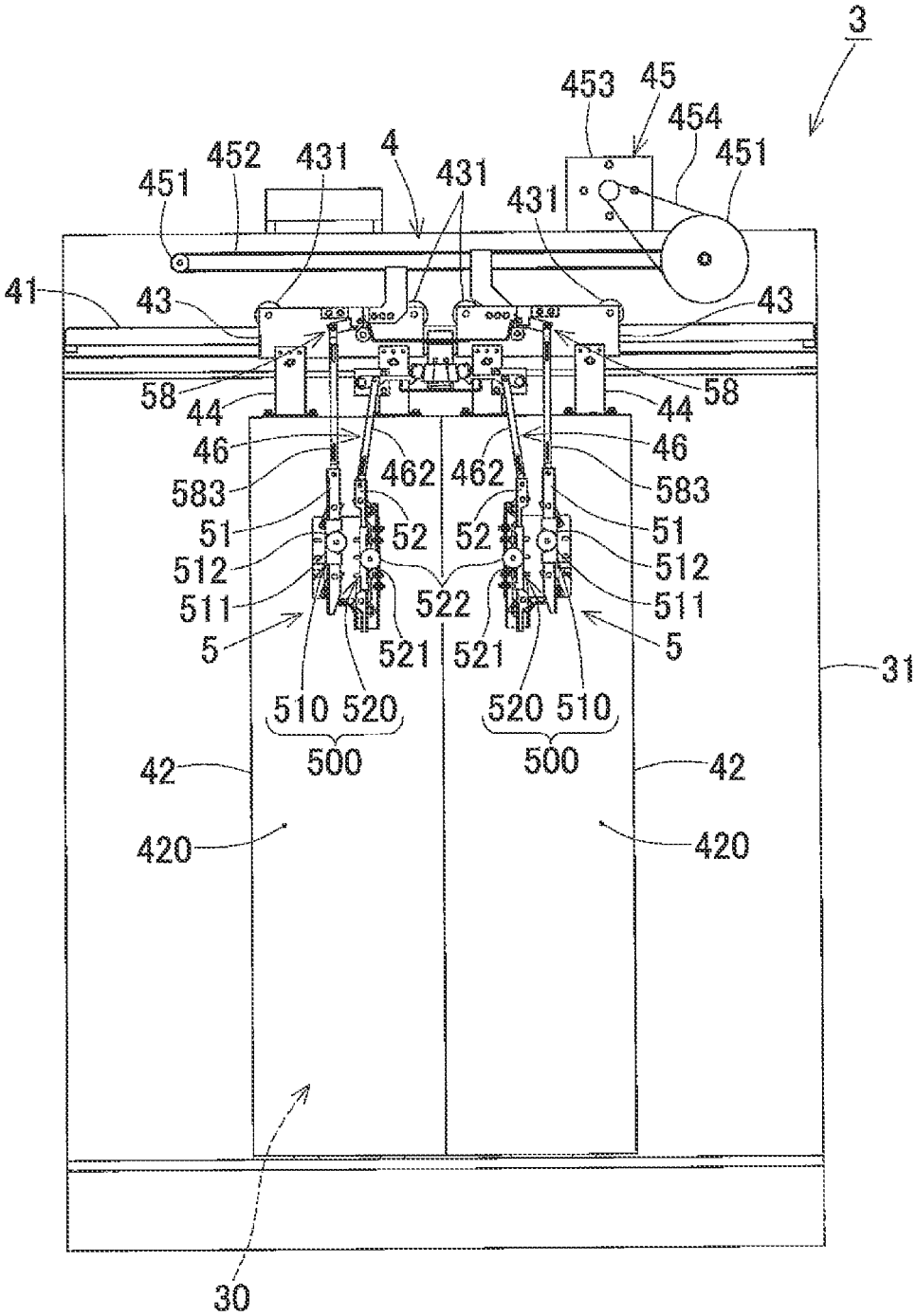
FIG. 2 is a front view of a car provided in the elevator of the first embodiment.
Figure 3:
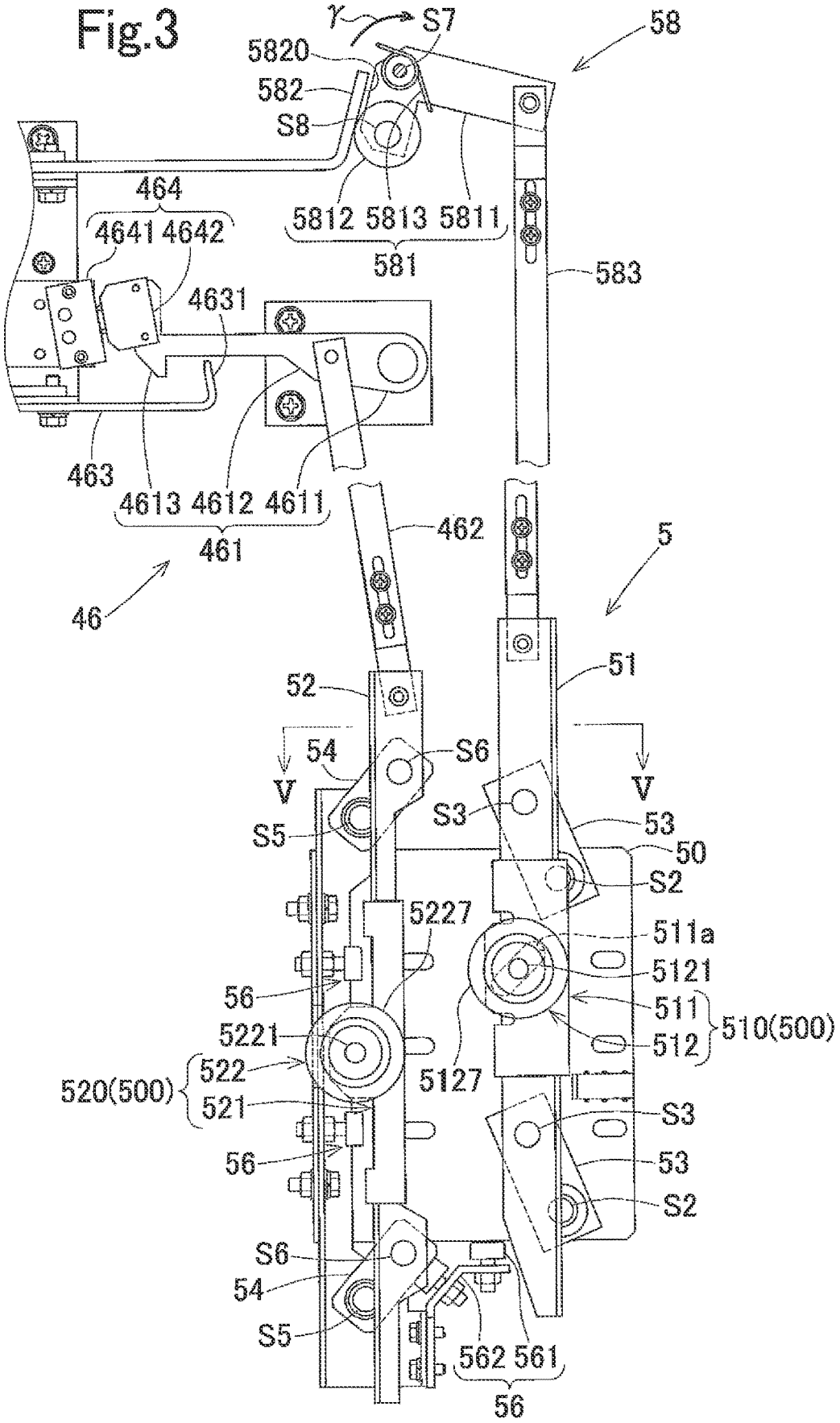
FIG. 3 is an explanatory diagram for the configuration of a door engagement device and a locking mechanism arranged in a door device of the elevator of the first embodiment.

As shown in FIG. 2, the door device 4 includes a guide rail 41 that extends in the width direction (i.e. the left-right direction in FIG. 2: hereinafter also referred to as "opening and closing direction") above the entrance opening 30 of the car 3, the car door 42 that is configured to open and close the entrance opening 30 of the car body 31, a door hanger 43 that allows the car door 42 to reciprocate along the guide rail 41 while allowing the car door 42 to hang down therefrom, and the door engagement device 5 arranged in or mounted to the car door 42. The door device 4 of this embodiment is a so-called center open type door device and includes two car door panels that together constitute the car door 42 and can move toward and away from each other in the opening and closing direction.

The door device 4 further includes a driving device 45 or the like that drives the car door 42 via the door hanger 43 in the opening and closing direction. The driving device 45 is arranged in the car body 31 and drives the car door 42 directly or indirectly.

Specifically, the driving device 45 includes a plurality of pulleys 451 that are mounted at an interval in the opening and closing direction above the guide rail 41, a first endless belt body 452 that is wound around the plurality of pulleys 451, and a motor 453 that rotationally drives at least one of the plurality of pulleys 451. The motor 453 and the at least one of the plurality of pulleys 451 are connected by a second endless belt 454.

The guide rail 41 extends in the opening and closing direction above the entrance opening 30 of the car body 31 to guide the car door 42 (specifically, the door hangers 43 with the car door panels respectively hanging down therefrom). The guide rail 41 of this embodiment is configured to guide each of the two panels of the car doors 42 in the opening and closing direction. Each of the two car door panels of the car door 42 is a panel having a vertically elongated rectangular shape.

The door hanger 43 is connected to the first endless belt 452 of the driving device 45 and is reciprocable along the guide rail 41 while having the car door 42 directly or indirectly hanging down therefrom. The door hanger 43 of this embodiment allows the car door 42 to hang down therefrom via an intermediate member 44. The door hanger 43 includes a plurality of rollers 431 that roll on the guide rail 41 when reciprocating along the guide rail 43.

The door engagement device 5 transmits driving force to open and close the car door 42 to the landing door 61. The engagement device 5 is mounted to an opposite surface 420 of the car door 42 facing the landing door 61 and is engageable with the engaged part 92 arranged in the landing door 61 when the car 3 lands the landing floor 6. The door engagement device 5 of this embodiment is mounted to each of the two door panels of the car door 42. Since the same configuration is applied to these two door engagement devices 5, the door engagement device 5 on one side (the right side in FIG. 2) will be hereinafter described.

The door engagement device 5 includes a first member 51 and a second member 52 (a pair of members moving toward and away from each other) configured to move toward and away from each other in the opening and closing direction with the engaged part 92 of the landing door 61 located therebetween as viewed from an entrance direction of the car 3 (hereinafter also simply referred to as "entrance direction") by the opening and closing of the car door 42, and an engaging part 500 including a first roller 512 and a second roller (a pair of rollers) configured to come into clamping engagement with the engaged part 92 and release the clamping engagement by movement of the first roller 512 and the second roller 522 toward and away from each other in association with the movement of the first member and the second member toward and away from each other. The engaging part 500 is capable of adjusting the position of at least one of the first roller 512 and the second roller 522 in the opening and closing direction at a clamping position (holding position) at which the engaged part 92 is clamped or held. The engaging part 500 of this embodiment is capable of adjusting the position of the first roller 512 in the opening and closing direction, and includes a first engaging part 510 including the first roller 512 and fixed to the first member 51 and a second engaging part 520 including the second roller 522 and fixed to the second member.

More specifically, as shown in FIG. 3 to FIG. 7, the door engagement device 5 includes a base 50 for fixing the door engagement device 5 to the car door 42, the first member 51 extending in the vertical direction, a first link member constituting together with the first member 51 a parallel link mechanism, the second member 52 arranged at a position with a distance from the first member 51 on a door closing side (the left side in FIG. 3), that is, arranged to be closer to the door closing side than the first member, in the opening and closing direction, and extending in the vertical direction, a first link member constituting together with the second member 52 a parallel link mechanism, the first engaging part 510 fixed to or arranged in the first member 51, and the second engaging part 520 fixed to or arranged in the second member 52. In the door engagement device 5 of this embodiment, the first link member includes a pair of first link elements 53 and the second link member includes a pair of second link elements 54.

The door engagement device 5 further includes a restricting part 56 that can restrict the motion of the second member 52, and a first-member driving mechanism 58 that drives the first member 51 in association with the opening and closing of the car door 42. The door device 4 of this embodiment includes a locking mechanism 46 that locks and unlocks the car door 42.

The base 50 includes a plate-shaped section extending outwardly along the car door 42 (i.e. the opposite surface 420) and is fixed to the opposite surface 420 of the car door 42.

The first member 51 is a so-called angle member extending in the vertical direction and having a substantially L-shape in the cross section. The first member 51 of this embodiment includes a first band section 51*a* extending outwardly in the vertical direction and the opening and closing direction and having a vertically elongated shape, and a first forward projection 51*b* projecting from the end edge on the door opening side of the first band section 51*a* toward the front side in the entrance direction and having a vertically elongated shape. The first forward projection 51*b* of this embodiment is arranged along the end edge on the door opening side of the first band section 51*a* at each of an upper portion (including the upper end) and a lower portion (including the lower end) with a distance from each other in the vertical direction. That is, the first member 51 of this embodiment includes two first forward projections 51*b* (see FIG. 4). In the first band section 51*a* of this embodiment, the dimension in the opening and closing direction of an intermediate portion between the two first forward projections 51*b* is smaller than the dimension in the opening and closing direction of each of the other portions (in which the first forward projections 51*b* are arranged).

The pair of first link elements 53 connect the base 50 and the first member 51 and are arranged with a distance from each other in the vertical direction. Each of the first link elements 53 is connected to the base 50 to be relatively rotatable around a shaft S2 extending in the entrance direction and connected to the first member 51 to be relatively rotatable around a shaft S3 extending in the entrance direction. This configuration allows the pair of first link elements 53 to constitute together with the first member 51 the parallel link mechanism. The pair of first link elements 53 of this embodiment each have a rectangular plate shape and are connected to the base 50 and the first member 51, respectively to have their longitudinal directions parallel to each other.

The second member 52 is a so-called angle member extending in the vertical direction and having a substantially L-shape in the cross section. The second member 52 of this embodiment includes a second band section 52*a* extending outwardly in the vertical direction and the opening and closing direction and having a vertically elongated shape, and a second forward projection 52*b* projecting from the end edge on the door closing side of the second band section 52*a* toward the front side in the entrance direction and having a vertically elongated shape. The second forward projection 52*b* of this embodiment is arranged along the end edge on the door closing side of the second band section 52*a* at each of an upper portion (including the upper end) and a lower portion (including the lower end) with a distance from each other in the vertical direction. That is, the second member 52 of this embodiment includes two second forward projections 52*b* (see FIG. 4). The distance between the two second forward projections 52*b* is smaller than the distance between the two first forward projections 51*b* of the first member 51. In the second band section 52*a* of this embodiment, the dimension in the opening and closing direction of a portion in which the second engaging part 520 is arranged is smaller than the dimension in the opening and closing direction of each other portion through which, for example, the second link elements 54 is connected.

The pair of second link elements 54 connect the base 50 with the second member 52 and are arranged with a distance from each other in the vertical direction. Each of the second link elements 54 is connected to the base 50 to be relatively rotatable around a shaft S5 extending in the entrance direction and connected to the second member 52 to be relatively rotatable around a shaft S6 extending in the entrance direction. This configuration allows the pair of second link elements 54 to constitute together with the second member 52 a parallel link mechanism. The pair of second link elements 54 of this embodiment each have a rectangular plate shape and are connected to the base 50 and the second member 52, respectively to have their longitudinal directions parallel to each other.

In this embodiment, the second member 52, which is not restricted from pivotally moving by the restricting part 56, is pivotally movable as shown in FIG. 3 to FIG. 11. However, the second member 52 can be held in a state of being unable to pivotally move by adjusting the position of the restricting part 56. The case where the second member 52 has been held in a state of being unable to pivotally move by adjusting the position of the restricting part 56 will be described later in the second embodiment.

In the parallel link mechanism including the first member 51 in the parallel link mechanisms configured as described above, the first member 51 can pivotally move (swing) between a first position (position shown in FIG. 3) defined by the first member driving mechanism 58 and a second position (position shown in FIG. 8) closer to the door closing side than the first position and defined by the restricting part 56. The restricting part 56 restricting the pivotal movement (range of pivotal movement) of the first member 51 includes at least one contact part 561 that is configured to come into contact with the lower-side of the first link element 53 connected to the first member 51 to thereby restrict the first member 51 from pivotally moving, and at least one holding part 562 that holds the contact part 561 while being directly or indirectly fixed to the car door 42. The contact part 561 includes a screw part to engage with, for example, the holding part 562, and is able to adjust the second position by adjusting the screwing amount of the screw part into the holding part 562. The holding part 562 of this embodiment is formed by bending a part of the base 50.

In the parallel link mechanism including the second member 52, the second member 52 can pivotally move (swing) between a third position (position shown in FIG. 8) defined by the restricting part 56 and a fourth position (position shown in FIG. 3) closer to the door opening side than the third position and defined by the restricting part 56. The same configuration of the restricting part 56 for restricting the pivotal movement (range of pivotal movement) of the first member 51 can be applied to the restricting part 56 for restricting the pivotal movement of the second member 52. That is, the restricting part 56 includes at least one contact part 561 and at least one holding part 562. Also, the holding part 562 of the restricting part 56 for restricting the pivotal movement of the second member 52 is formed by bending a part of the base 50 in the same manner as the restricting part 56 for restricting the pivotal movement of the first member 51 (see FIG. 5 and FIG. 9).

The engaging part 500 including the first engaging part 510 and the second engaging part 520 as described above is configured to clamp the engaged part 92 of the landing door 61 by the rollers 512, 522 of the engaging parts 510, 520 to allow the door engagement device 5 to engage with the engaged part 92, thereby allowing the driving device 45 (motor 453) of the door device 4 to transmit the driving force to open and close the car door 42 to the landing door 61.

The first engaging part 510 includes the first roller 512 and a first roller support part (bracket) 511 that is mounted to or arranged in the first member 51 and supports the first roller 512.

The first roller support part 511 includes a first plate section (hereinafter also simply referred to as "plate section") 5111 including a first elongated hole 511*a* and extending outwardly in the vertical direction and the opening and closing direction. The first roller support part 511 of this embodiment includes first rearward projections 5112 projecting from the end edge on the door closing side of the first plate section 5111 toward the rear side in the entrance direction and having a vertically elongated shape.

The first plate section 5111 has a vertically elongated rectangular shape and includes a notch 5111*a* extending from the end edge on the door closing side toward the door opening side. The first plate section 5111 of this embodiment includes two notches 5111*a* that are arranged with a distance from each other in the vertical direction. In the first plate section 5111 of this embodiment, the upper notch 5111*a* in the vertical direction is arranged at a position corresponding to the lower end of the first forward projection 51*b* on the upper side of the first member 51, and the lower notch 5111*a* is arranged at a position corresponding to the upper end of the first forward projection 51*b* on the lower side of the first member 51. In the first plate section 5111, a portion between the two notches 5111*a* (intermediate portion of the notches) 5113 projects in the door closing direction from a portion above the upper notch 5111*a* and a portion below the lower notch 5111*a*. The intermediate portion 5113 between the notches 5111*a* has inclined sides 5111*b* respectively located at the upper corner and the lower corner of the end edge on the door closing side and inclined to the vertical direction and the opening and closing direction.

The first elongated hole 511*a* passes through the first plate section 5111 in the entrance direction and extends in the direction including a component in the opening and closing direction. Specifically, the first elongated hole 511*a* is arranged in the intermediate portion 5113 between the notches 5111*a* and extends in the direction inclined to the vertical direction and the opening and closing direction. More specifically, the first elongated hole 511*a* extends in such an inclined direction as to be located more upward as it extends toward the door opening side. The first elongated hole 511*a* of this embodiment extends straight in the direction at 45° with respect to the opening and closing direction. In the first plate section 5111, a hole peripheral portion 511*b* of the first elongated hole 511*a* has a pair of linear edges 511*c* defining the first elongated hole 511*a* and extending in the inclined direction parallel to each other. The pair of linear edges 511*c* are connected to each other at their ends corresponding to or opposite to each other by arc-shaped edges 511*d* projecting outward.

The first rearward projections 5112 extend rearward in the entrance direction from a portion above the upper notch 511*a* and a portion below the lower notch 5111*a* on the lower side along the end edge on the door closing side.

The first roller support part 511 configured as described above is mounted to the central portion in the vertical direction of the first member 51 by connecting the distal ends of the first forward projections 51*b* of the first member 51 with the end edge on the door opening side of the first plate section 5111 in the state where the first plate section 5111 and the first band section 51*a* face each other in the entrance direction, while connecting the end edge on the door closing side of the first band section 51*a* of the first member 51 with the distal ends of the first rearward projections 5112 of the first roller support part 511.

The first roller 512 is fixed to the first roller support part 511. That is, the first roller 512 is fixed to or arranged in the first member 51 via the first roller support part 511. The first roller 512 of this embodiment is arranged between the pair of first link elements 53 as viewed from the lateral side of the car door 42 (as viewed from the opening and closing direction). The first roller 512 includes a first roller shaft part (hereinafter also simply referred to as "shaft") 5121 extending in the entrance direction and a first roller body 5127 rotatable around the first roller shaft part 5121. The first roller 512 of this embodiment includes a washer W and a nut N for fixing the first roller shaft part 5121 to the first roller support part 511.

The first roller shaft part 5121 includes a roller engaging section 5122 configured to engage with or hold the first roller body 5127, a flange 5123 extending outwardly from the rear side end in the entrance direction of the roller engaging section 5122, and an insertion section 5124 extending from the flange and allowed to insert into the first elongated hole 511*a*. In the first roller shaft part 5121 of this embodiment, the roller engaging section 5122, the flange 5123, and the insertion section 5124 are integrally formed. That is, the insertion section 5124 is constituted by a part of the first roller shaft part 5121.

The roller engaging section 5122 extends in the entrance direction and is configured to engage with the first roller body 5127 rotatably around the roller engaging section 5122 as a central axis (i.e., rotation axis).

The flange 5123 extends outwardly along the hole peripheral section 511*b* of the first elongated hole 511*a*. More specifically, the flange 5123 is a portion having a disc shape extending outwardly along the front surface in the entrance direction of the hole peripheral section 511*b*. The flange 5123 herein extends outwardly from one end in the entrance direction (i.e., insertion direction) of the insertion section 5124 along the hole peripheral section 511*b*.

The insertion section 5124 is inserted into the first elongated hole 511*a* so as to be movable along the first elongated hole 511*a*. The insertion section 5124 includes a sliding section 5125 located inside the first elongated hole 511*a*, and a male screw 5126 extending from the sliding section 5125 (see FIG. 6 and FIG. 7).

The sliding section 5125 includes a pair of sliding surfaces respectively extending along the pair of linear edges 511*c* defining the first elongated hole 511*a* and being slidable with respect to the linear edges 511*c*. The pair of sliding surfaces 5125*a* are surfaces formed in parallel to each other and facing oppositely to each other with a distance corresponding to the width of the first elongated hole 511*a* (i.e., the distance between the linear edges 511*c*). The dimension of the sliding section 5125 in the entrance direction is equal to or slightly smaller than the thickness of the first plate section 5111 of the first roller support part 511.

The male screw 5126 directly or indirectly extends from the flange 5123. The male screw 5126 of this embodiment extends from the flange 5123 through the sliding section 5125. The diameter of the male screw 5126 is equal to or slightly smaller than the distance between the pair of sliding surfaces 5125*a*. There is a distance a between the distal end of the male screw 5126 and the first member 51 (specifically, the first band section 51*a* of the first member 51) in the entrance direction (see FIG. 5 and FIG. 9). The distance a is smaller than the dimension in the entrance direction of the nut N that is in screw engagement with or engages with the male screw 5126. In other words, the first plate section 5111 of this embodiment is arranged at a position at which the distance between the distal end of the insertion section 5124 (i.e. the male screw 5126) and the first member 51 (i.e. the first band section 51*a*) is smaller than the dimension in the entrance direction (insertion direction) of the nut N.

The first roller body 5127 is rotatable around the roller engaging section 5122 (i.e. the first roller shaft part 5121) as a rotational center extending in the entrance direction and arranged so that a peripheral surface 5127*a* of the first roller body 5127 faces the engaged part 92 of the landing door 61 when the car 3 lands on a desired landing floor 6.

The first roller shaft part 5121 configured as described above allows the insertion section 5124 (i.e. the male screw 5126) inserted into the first elongated hole 511*a* to be inserted into the washer W and being brought into screw engagement with the nut N, while allowing the flange 5123 to be in contact with the hole peripheral section 511*b* of the first elongated hole 511*a*. This configuration allows the hole peripheral section 511*b* of the first elongated hole 511*a* to be held between the flange 5123, and the washer W and the nut N. As a result, the first roller shaft part 5121 is fixed to the first roller support part 511. When the nut N is loosened, the first roller 512 can be displaced along the first elongated hole 511*a* in the direction in which the first elongated hole 511*a* extends, and when the nut N is tightened at a desired position, the first roller 512 can be fixed at such a desired position. This change in position of the first roller 512 enables to change or adjust the distance between the first roller 512 and the second roller 522 at the position for clamping the engaged part 92.

Further, when the first roller shaft part 5121 is thus mounted to the first member 51 via the first roller support part 511, the first roller 512 is held in a state of being supported by the parallel link mechanism including the first member 51 with respect to the base 50 fixed to the car door 42. Thereby, the first roller 512 can pivotally move or swing together with the first member 51 while keeping the posture of the rotation axis (i.e. the first roller shaft part) 5121 of the first roller body 5127 facing the entrance direction.

The second engaging part 520 includes a second roller 522 and a second roller support part (bracket) 521 that is mounted to the second member 52 and supports the second roller 522.

The second roller support part 521 includes a second plate section 5211 extending outwardly in the vertical direction and the opening and closing direction and a second rearward projection 5212 projecting from the end edge on the door opening side of the second plate section 5211 and having a vertically elongated shape.

Figure 4:
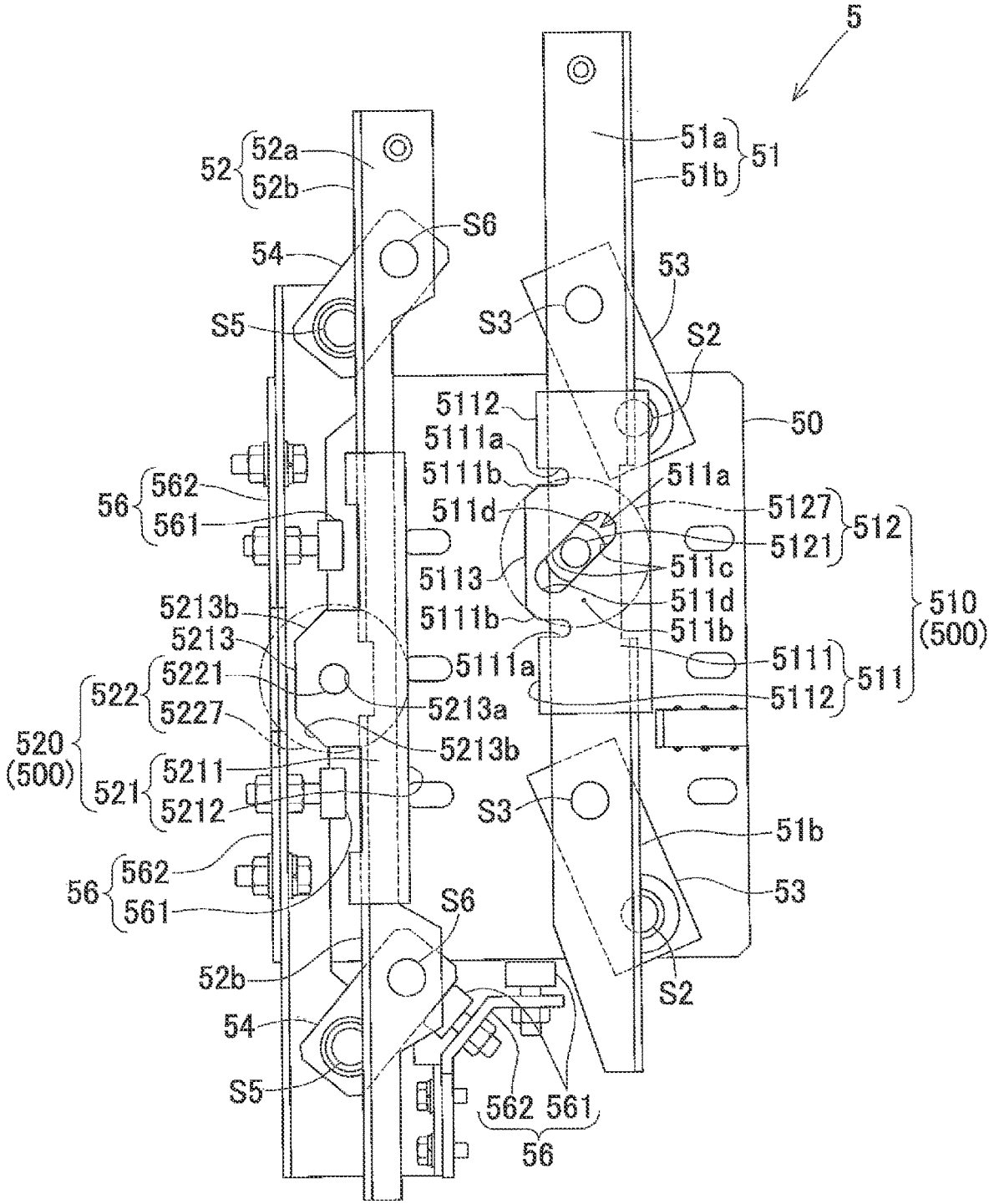
FIG. 4 is a front view of the door engagement device of the first embodiment.
Figure 5:
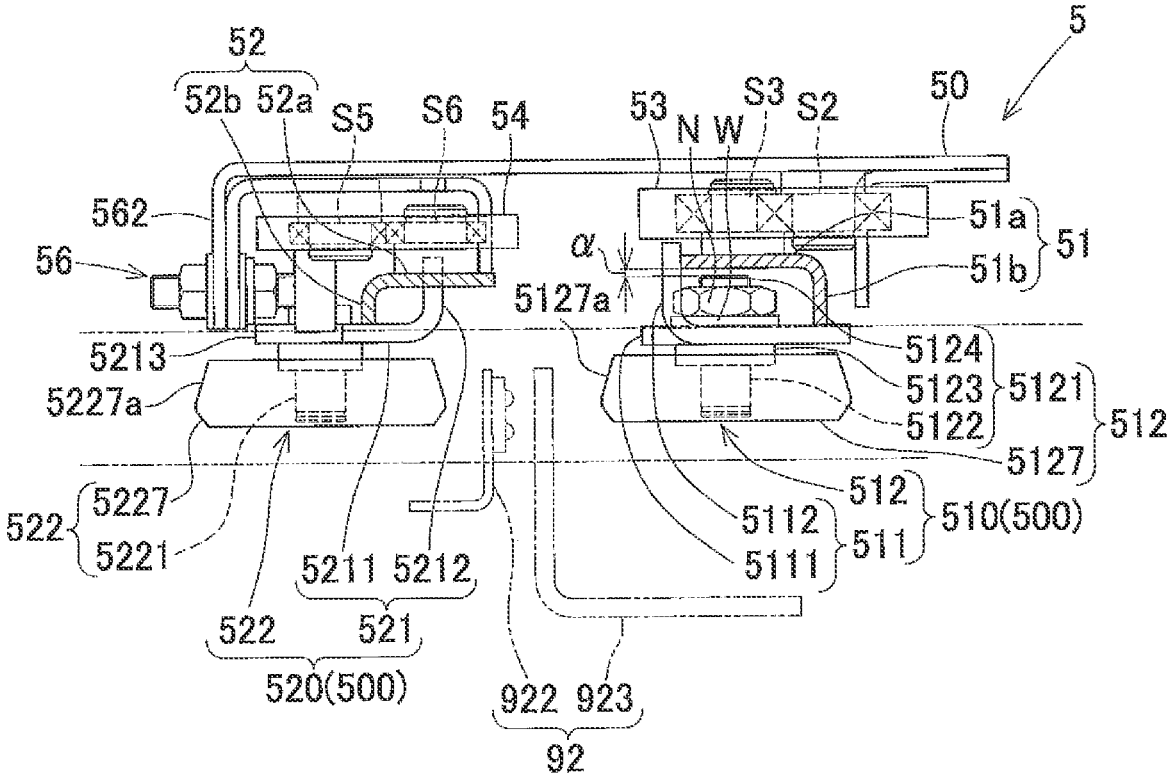
FIG. 5 is a cross sectional view as taken along the line and viewed in the direction of arrows V-V in FIG. 3.
Figure 6:
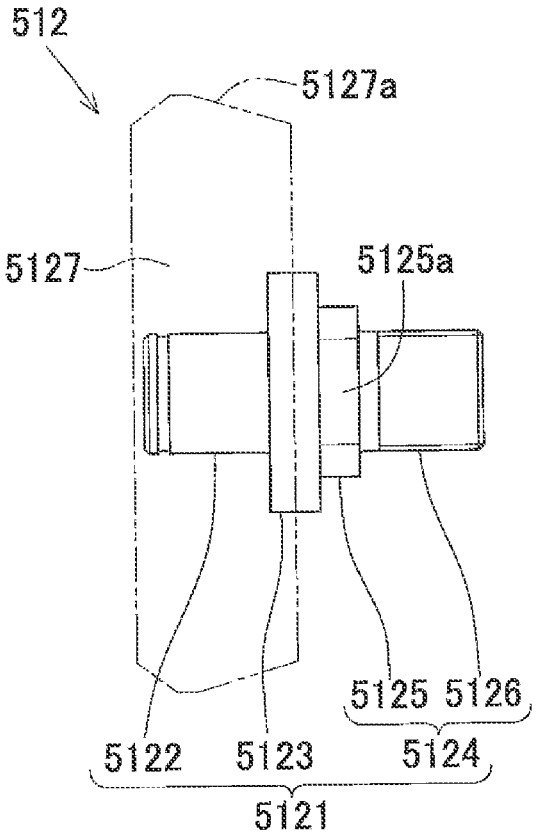
FIG. 6 is a side view of a first roller shaft part provided in the door engagement device of the first embodiment.
Figure 7:
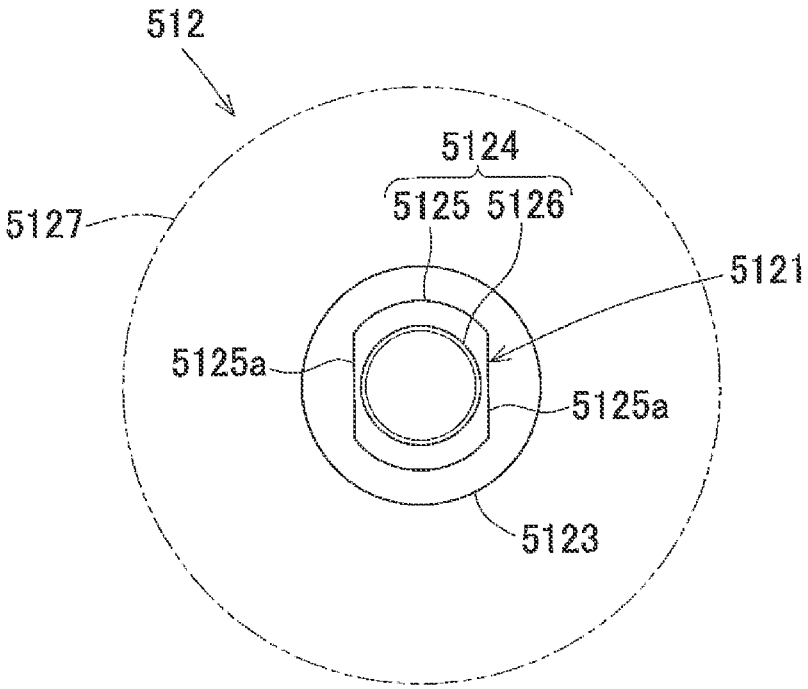
FIG. 7 is a front view of the first roller shaft part of the first embodiment.
Figure 8:
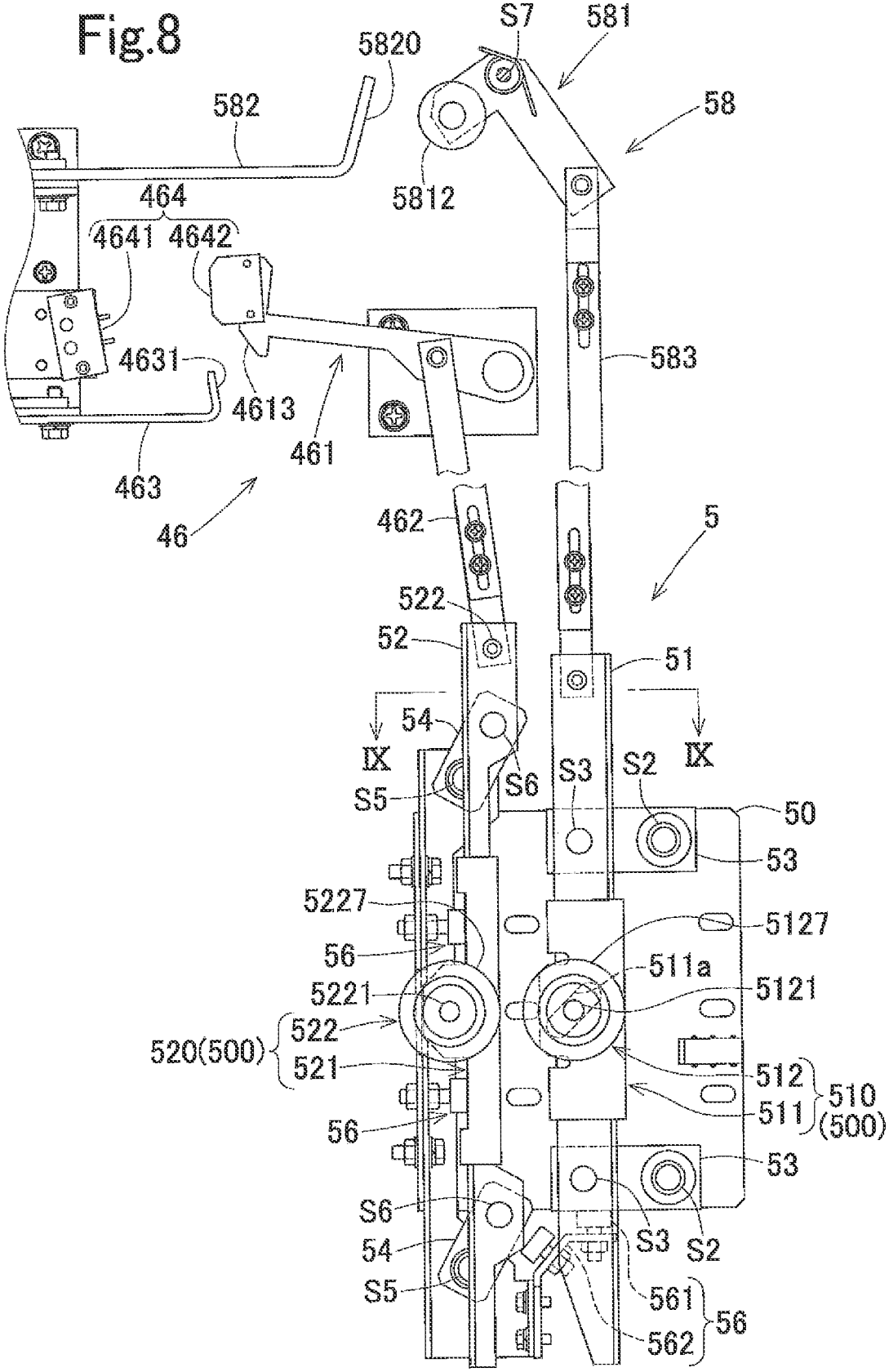
FIG. 8 is an explanatory diagram for the configuration of the door engagement device the locking mechanism of the first embodiment in which an engaged part of the landing door is clamped.
Figure 9:
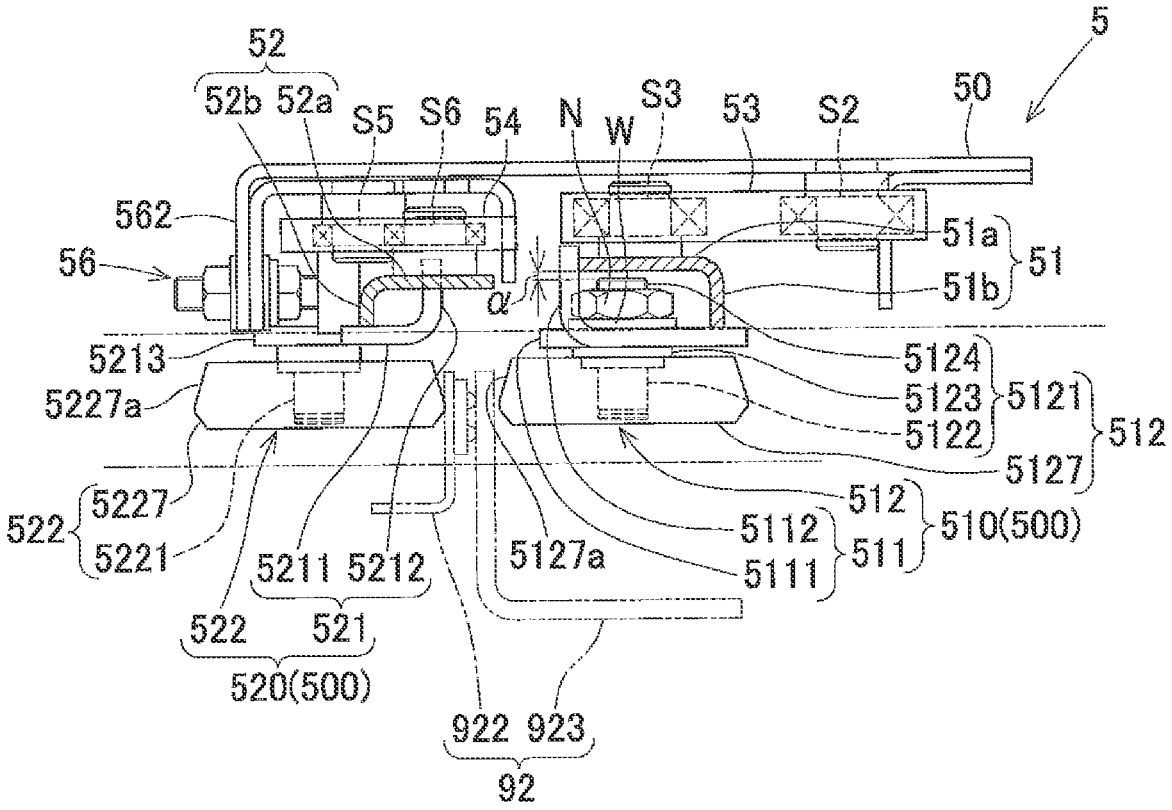
FIG. 9 is a cross sectional view as taken along the line and viewed in the direction of arrows IX-XI in FIG. 8.
Figure 10:
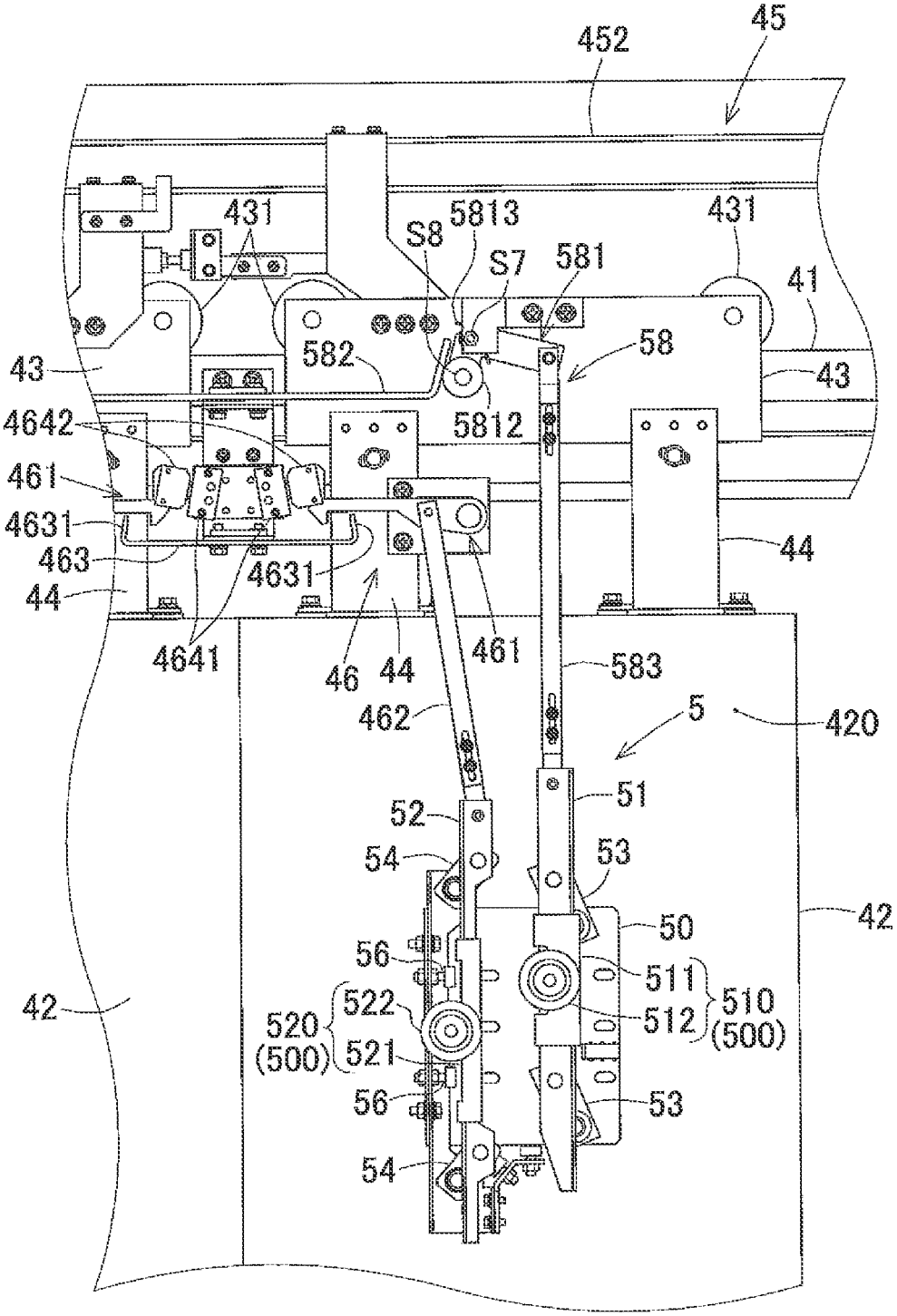
FIG. 10 is an explanatory diagram for the motion of the door engagement device and the locking mechanism of the first embodiment.
Figure 11:
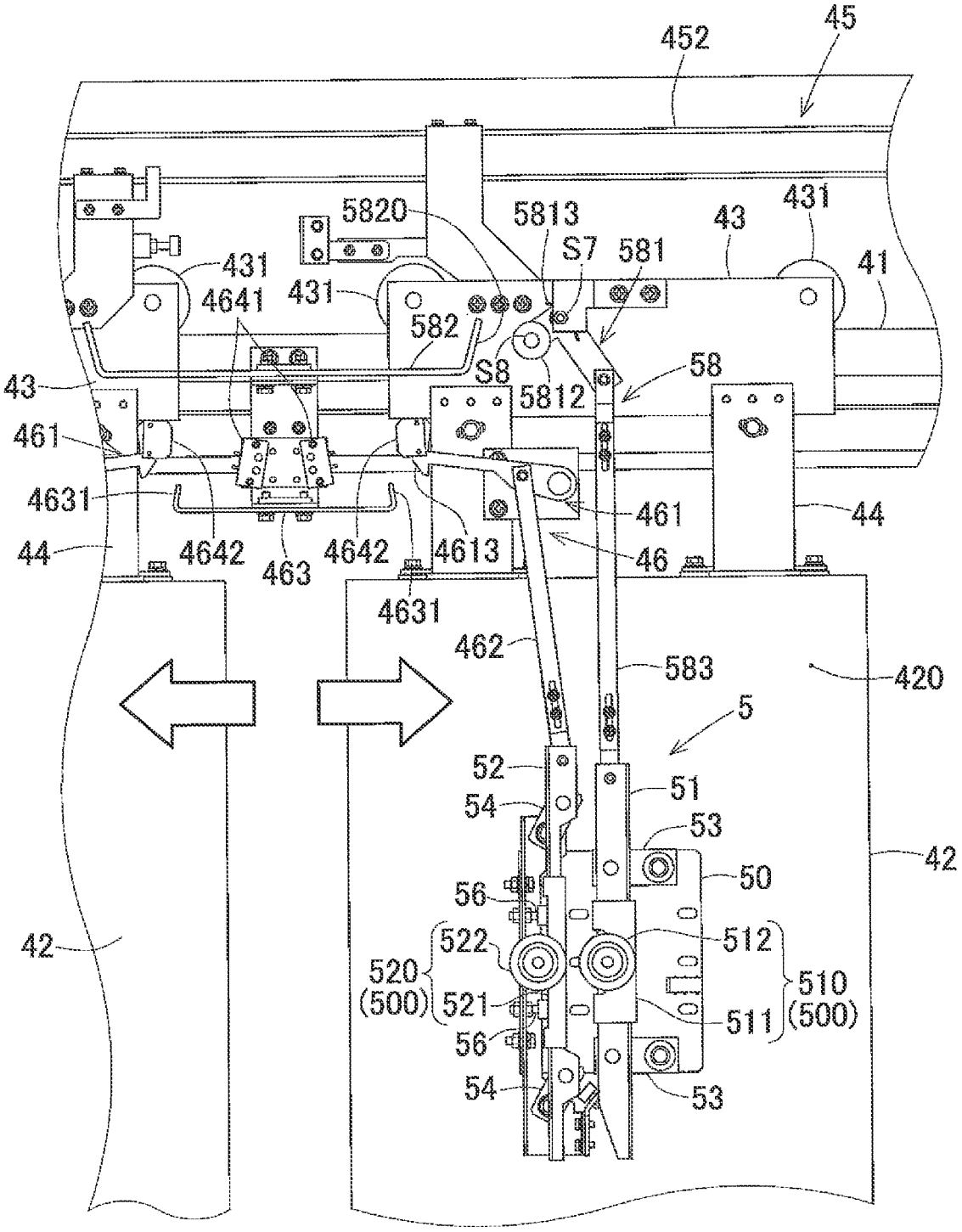
FIG. 11 is an explanatory diagram for the motion of the door engagement device and the locking mechanism of the first embodiment.
Figure 12:
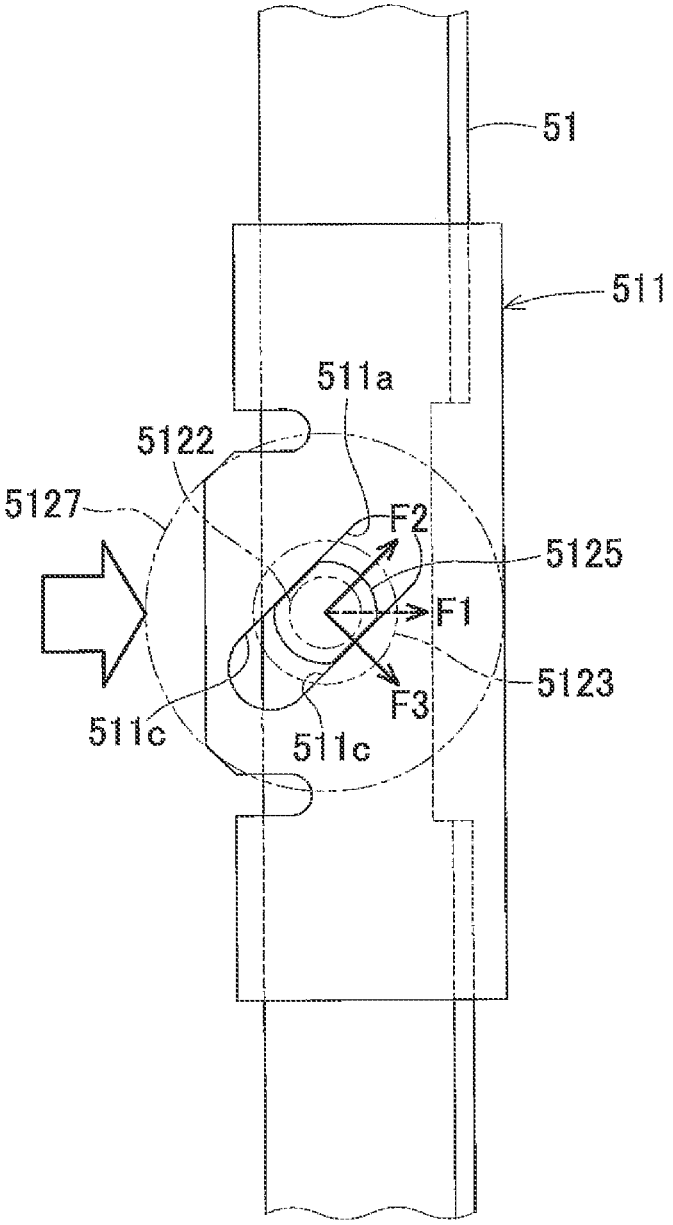
FIG. 12 is an explanatory schematic diagram for the force applied to the first roller provided in the door engagement device of the first embodiment.

The second plate section 5211 has a vertically elongated band shape and includes an extending section 5213 extending from the central portion in the vertical direction along the end edge on the door closing side toward the door closing side (see FIG. 4). The extending section 5213 includes a hole 5213 passing through the central portion in the entrance direction. The extending section 5213 further includes inclined sides 5213*b* respectively located at the upper corner and the lower corner of the end edge on the door closing side and inclined to the vertical direction and the opening and closing direction.

The second rearward projection 5212 extends from the entire area in the vertical direction of the end edge on the door opening side toward the rear side in the entrance direction.

The second roller support part 521 configured as described above is mounted to the central portion in the vertical direction of the second member 52 by connecting the distal ends of the second forward projections 52*b* of the second member 52 with the end edge on the door closing side of the second plate section 5211 in the state where the second plate section 5211 and the second band section 52*a* face each other in the entrance direction, while connecting the end edge on the door closing side of the second band section 52*a* of the second member 52 with the distal ends of the second rearward projection 5212 of the second roller support part 521.

The second roller 522 is fixed to the second roller support part 521. That is, the second roller 522 is fixed to or arranged in the second member 52 via the second roller support part 521. The second roller 522 of this embodiment is arranged between a pair of first link elements 54 as viewed from the lateral side of the car door 42 (as viewed from the opening and closing direction). The second roller 522 includes a second roller shaft part 5221 extending in the entrance direction and a second roller body rotatable around the second roller shaft part 5221.

The second roller shaft part 5221 extends in the entrance direction and is configured to engage with or hold the second roller body 5227 rotatably around the second roller shaft part 5221 as a central axis (i.e., rotation axis). The second roller shaft part 5221 is fixed to the extending section 5213 while passing through a hole 5213*a* of the extending section 5213 from the front to the rear side in the entrance direction.

The second roller body 5227 is rotatable around the second roller shaft part 5221 as a rotational center extending in the entrance direction and arranged so that a peripheral surface 5227*a* of the second roller body 5227 faces the engaged part 92 of the landing door 61 when the car 3 lands on a desired landing floor 6.

The second roller 522 configured as described above is mounted to the second member 52 via the second roller support part 521 so that the second roller 522 is held in a state of being supported by the parallel link mechanism including the second member 52 with respect to the base 50 fixed to the car door 42. Thereby, the second roller 522 can pivotally move or swing together with the second member 52 while keeping the posture of the rotation axis (i.e. the second roller shaft part) 5221 of the second roller body 5227 facing the entrance direction. In the state where the first member 51 and the second member 52 are located closest to each other, that is, are located at a position for clamping the engaged part 92 by the pivotal movement or swinging, the first roller 512 (the first roller body 5127) and the second roller 522 (the second roller body 5227) are located at the same or substantially the same position in the vertical section (see FIG. 8).

The first member driving mechanism 58 is arranged above the car 3 (specifically, arranged at the door hanger 43 in the example of this embodiment) and drives the first member 51 utilizing the movement of the car door 42 in the opening and closing direction, to thereby allow the first roller 512 and the second roller 522 to clamp or hold the engaged part 92 of the landing door 61. The first member driving mechanism 58 includes a cam mechanism. Specifically, the first member driving mechanism 58 includes a cam 581 that is pivotally movable around a shaft S7 extending in the entrance direction, a cam contact part 582 which the cam 581 contacts by the closing of the car door 42, and a coupling member 583 that couples the cam 581 with the first member 51.

The cam 581 includes a cam body 5811, a contact roller 5812 arranged on the cam body 5811, and a biasing member 5813 for biasing the cam body 5811. The cam body 5811 is mounted to the door hanger 43 while being pivotally movable around the shaft S7. The contact roller 5812 is arranged on the door closing side end (distal end) of the cam body 5811 while being rotatable around a shaft S8 extending in the entrance direction.

The biasing member 5813 biases the cam body 5811 in the rotating direction in which the cam body 5811 rotates around the shaft S7 (see the arrow yin FIG. 3) so that the door closing side end of the cam body 5811 extends upward, while the door opening side end extends downward. The biasing member 5813 of this embodiment is, for example, a coil spring, and generates a biasing force by its partial contact with or partial fixing to the door hanger 43.

The coupling member 583 is a member extending in a given direction and couples the door opening side end of the cam 581 with an upper end of the first member 51. When the cam 581 pivotally moves, the coupling member 583 transmits the vertical movement of the door opening side end of the cam body 5811 in association with the pivotal movement to thereby pivotally move or vertically move the first member 51. The length of the coupling member 583 of this embodiment is adjustable.

The cam contact part 582 is fixed to, for example, the car body 31. The cam contact part 582 has a contact surface 582, which the contact roller 5812 of the cam 581 contacts, when the car door 42 closes. The contact surface 5820 allows the contact roller 5812 to come into contact therewith just before the car door 42 reach the fully-closed position in the doors closing operation, so that it prevents the contact roller 5812 from moving further toward the door closing side when the car door 42 is further moved to close.

The locking mechanism 46 is configured to lock so as not to open the car door 42 when the car door 42 is at the fully-closed position, and unlock by a certain movement applied when the car door 42 moves from the fully-closed position toward the door opening direction.

Specifically, as shown in FIG. 2, FIG. 3, FIG. 8, FIG. 10, and FIG. 11, the locking mechanism 46 includes an engaging part 461 that is mounted on the door hanger 43 or the intermediate member 44 arranged between the door hanger 43 and the car door 42, a transmission member 462 that transmits driving force from the door engagement device 5 (i.e. the pivotal movement of the second member 52) to the engaging part 461, and a locking mechanism engaged part 463 that is mounted on the car body 31 or a member or part fixed to the car body 31. In the locking mechanism 46, the engaging part 461 engages with the locking mechanism engaged part 463 or comes into an engaging position so that the car door 42 can be locked so as not to open (specifically, can restrict the two door panels of the car door 42 from moving in a direction away from each other). The locking mechanism 46 of this embodiment further includes a detector 464 that can detect whether the locking mechanism 46 is in locking or unlocking state.

The engaging part 461 includes a base 4611 that is pivotally movable around a shaft extending in the entrance direction, an extending part 4612 that extends from the base 4611 and to which the transmission member 462 is relatively rotatably connected, and a hook 4613 that is arranged at a distal end (i.e. an opposite end to the base 4611) of the extending part 4612. When the engaging part 461 is pushed upward through the transmission member 462 by the pivotal movement of the second member 52 (that is, shifted from the state shown in FIG. 3 to the state shown in FIG. 8), the engaging part 461 pivotally moves around the shaft to come into a position where it is out of engagement with the locking mechanism engaged part 463 (that is, come into the releasing position) (see FIG. 8). On the other hand, when the engaging part 461 is pulled downward through the transmission part 462 by the pivotal movement of the second member 52 (that is, shifted from the state shown in FIG. 8 to the state shown in FIG. 3), the engaging part 461 pivotally moves around the shaft (i.e., the pivotal movement in the opposite direction to the direction of the pivotal movement when coming into the releasing position) to come into a position where it can engage with the locking mechanism engaged part 463 (that is, come into the engaging position) (see FIG. 3).

The locking mechanism engaged part 463 is a plate-shaped member fixed to the guide rail 41 and extending in the door opening direction, and has a bent portion at a distal end 4631. The distal end 4631 is configured to be engageable with the engaging part 461 (i.e. the hook 4613) when in an engaging position.

The detector 464 includes a switch 4641 that is fixed to the locking mechanism engaged part 463, and a contact 4642 that is arranged at the hook 4613 of the engaging part 461. The detector 464 is configured to detect that the car door 42 is held locked through the conduction due to the contact of two contact points of the switch 4641 with the contact 4642.

The transmission member 462 transmits the driving force of the driving device 45 to the engaging part 461 by the coupling of the second member 52 with the engaging part 461. Specifically, the transmission member 462 is an elongated member extending in a certain direction and has an upper end relatively rotatably connected to the extending part 4612 of the engaging part 461, and a lower end relatively rotatably connected to the upper end of the second member 52. The transmission member 462 transmits the pivotal movement (i.e., vertical movement) of the second member 52 to the engaging part 461. The length of the transmission member 462 of this embodiment is adjustable.

Figure 19:
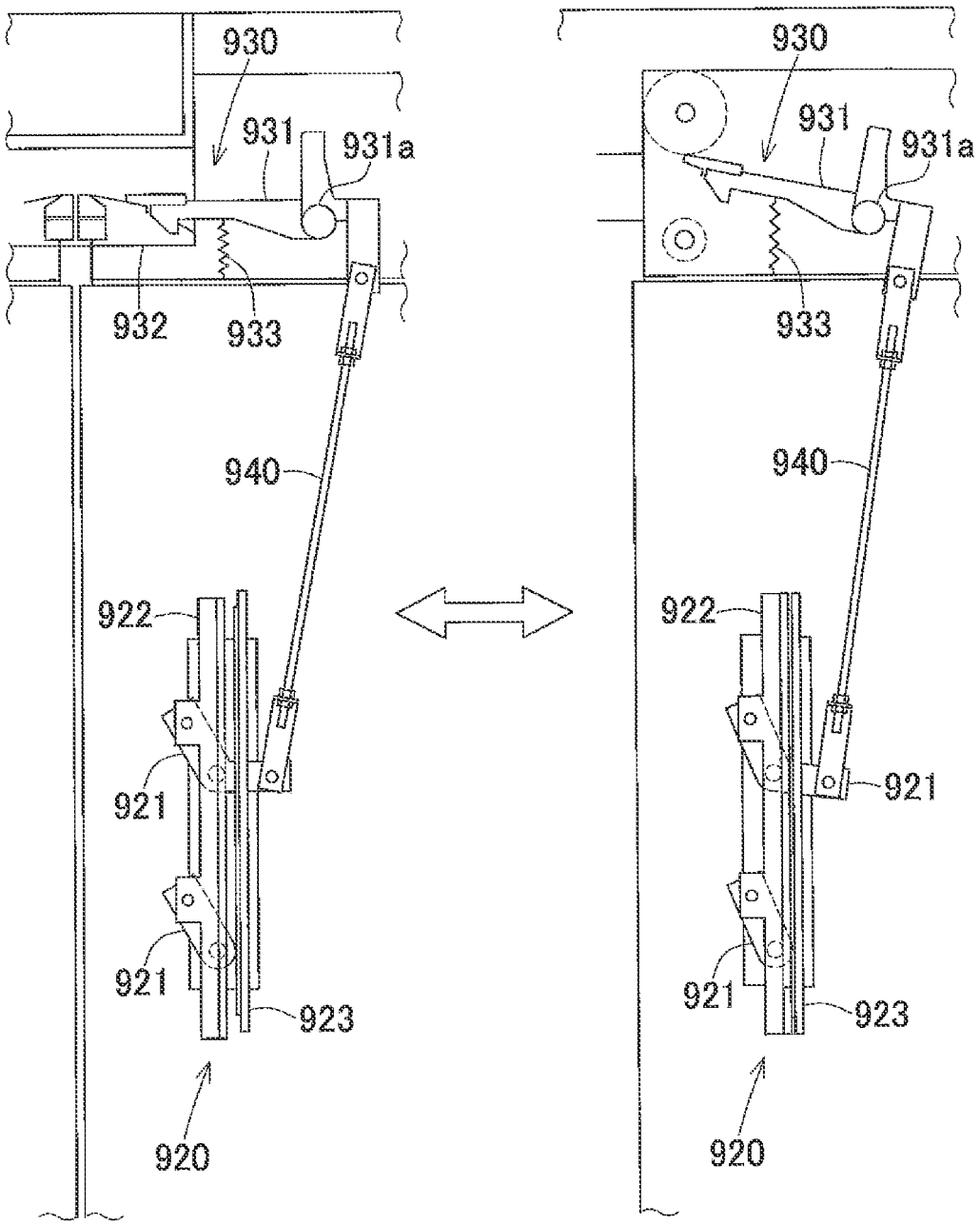
FIG. 19 is an explanatory diagram for an engaged part and a landing side locking mechanism of a landing door corresponding to a door engagement device of the swing arm type.

In the elevator 1 of this embodiment, the engaged part 92 of the landing door 61 to be engaged with the door engagement device 5 of the car door 42 is included in the engagement device for opening and closing the landing door. The engagement device is installed corresponding to the driving device for the car door of the swing arm type. The engagement device for opening and closing the landing door includes, for example, a landing side locking mechanism 930 and the engaged part 920 as shown in FIG. 19.

The landing side locking mechanism 930 includes a latch 931 that is arranged above the landing door 61 and arranged to be pivotally movable around a shaft 913*a* extending in the entrance direction, a latch receiver 932 that is provided above the entrance of the landing floor 6 to be engageable with the latch 931, and a tension spring 933 that biases the latch 931 in the direction in which the latch 931 engages with the latch receiver 932.

The engaged part 920 further includes a pair of link elements 921 arranged away from each other in the vertical direction and pivotally supported by the landing door 61, an unlock plate 922 supported by the link elements 921 and extending in the vertical direction, and an engaging plate 923 fixed to the landing door 61 and extending in the vertical direction. The engaged part 920 further includes a rod 940 that couples one of the pair of link elements 921 (specifically, the upper link element in the example shown in FIG. 19) with the latch 931. In the engaged part 920, the rod 940 is pulled downward when the unlock plate 922 and the engaging plate 923 located with a distance from each other in the opening and closing direction and extending in the vertical direction come close to each other in the opening and closing direction, while the rod 940 is pulled upward when the unlock plate 922 and the engaging plate 923 move away from each other. Thereby, the landing side locking mechanism 930 performs the locking and unlocking operations.

In the elevator 1 configured as described above, the door engagement device 5 transmits the driving force (i.e. the driving force to open and close the car door 42) of the driving device 45 to the landing door 61 via the engaged part 92 to thereby enable the landing door 61 to follow the opening and closing of the car door 42. That is, the landing door 61 opens and closes in association (synchronization) with the car door 42 of the car 3.

Specifically, when the car 3 is raised or lowered within the elevator shaft 2 to land on a desired landing floor 6, the engaged part 92 (the unlock plate 922 and the engaging plate 923) arranged in the landing door 61 enters between the first roller 512 and the second roller 522 of the door engagement device 5 arranged in the car door 42 from the above or below.

After the car 3 lands on the landing floor 6, the driving device 45 drives the door hangers 43 to respectively move the door panels of the car door 42, which hang down from the door hangers 43, from the fully-closed position (i.e. the door closed state) in the door opening direction. Along with this movement, the contact roller 5812 of the first member driving mechanism 58 moves away from the cam contact part 582 to allow the cam body 5811 to pivotally move around the shaft S7 due to the biasing force of the biasing member 5813 (see the arrow yin FIG. 3) so that the first member 51 is pulled downward via the coupling member 583. As a result, the first roller 512 pivotally moves together with the first member 51 toward the second roller 522 side to clamp the unlock plate 922 and the engaging plate 923 between the first roller 512 and the second roller 522.

At this time, the second roller 522 comes into contact with the unlock plate 922 to allow the second member 52 to pivotally move from the fourth position to the third position so that the hook 4613 is pulled upward via the transmission member 462 to thereby unlock the car door 42. Also, the unlock plate 922 clamped together with the engaging plate 923 by the second roller 522 and the first roller 512 pivotally moves or comes close to the position at which the unlock plate 922 contacts the engaging plate 923. Consequently, one of the link elements 921 pivotally moves to thereby unlock the landing side locking mechanism 930.

This operation proceeds in reverse order when the doors close. Specifically, the driving device 45 drives the door hanger 43 to respectively move the two door panels of the car door 42, which hang down from the door hangers 43, from the fully-opened position (door opened state) in the door closing direction. At this time, the engaged part 92 (the unlock plate 922 and the engaging plate 923) is pushed by the first roller 512 in the door closing direction, while being clamped between the first roller 512 and the second roller 522, to thereby close the landing door 61 along with the car door 42.

The contact roller 5812 of the first member driving mechanism 58 comes into contact with the cam contact part 582 just before the car door 42 reaches the fully-closed position (i.e. the door closed state). When the car door 42 in this state moves further in the door closing direction, the contact roller 5812 is pushed by the cam contact part 582 to pivotally move the cam 581 (i.e. the cam body 5811) around the shaft S7. This pivotal movement allows the coupling member 583 to be pulled upward against the biasing force of the biasing member 5813 and thereby allows the first member 51 to be pivotally move in the direction away from the second member 52. As a result, the first roller 512 is separated from the engaged part 92 of the landing door 61. When the first roller 512 is separated from the engaged part 92, the landing door 61 reaches the fully-closed position.

When the car door 42 moves to the fully-closed position, the second roller 522 is separated from the engaged part 92 of the landing door 61 and pivotally moves from the third position to the fourth position side by its own weight or the like. Thereby, the engaging part 461 (i.e. the extending part 4612) is pulled downward through the transmission member 462. As a result, the engaging part 461 pivotally moves to pull the hook 4613 downward and thereby allows the hook 4613 to come into the engaging position to engage with the locking mechanism engaged part 463. That is, the locking mechanism 46 is held in a locking state to lock the car door 42.

When the locking mechanism 46 is held in the locking state, that is, the engaging part 461 comes into the engaging position, the contact 4642 arranged at the engaging part 461 enables the conduction between the two contact points of the switch 4641, and thereby enables the detector 464 to detect that the car door 42 has been locked by the locking mechanism 46. Upon the detection, the car 3 can be raised or lowered.

Each of the first roller 512 and the second roller 522 is separated from the engaged part 92 in the state where the detector 464 D locked state. Thus, no interference occurs between the door engagement device 5 and the engaged part 92 even when the car 3 is raised or lowered.

According to the door engagement device 5 of the elevator 1 described above, the movement of the car door 42 in the door opening direction causes the parallel link mechanism to swing the first member 51 and the second member 52, while causing the first roller 512 and the second roller 522 respectively arranged in the first member 51 and the second member 52 to clamp the engaged part 92 arranged in the landing door 61. Thus, this enables the locking mechanism of the landing door provided corresponding to the door opening and closing device of the swing arm type to be locked and unlocked.

In the door engagement device 5 of the elevator 1 of this embodiment, the first roller 512 is arranged between the pair of first link elements 53, that is, arranged substantially at an intermediate position as viewed from the lateral side of the car door 42. Therefore, the stress applied to the first roller 512 from the engaged part 92 is substantially uniformly dissipated to the pair of first link elements 53 via the first member 51.

In the door engagement device 5 of this embodiment, the second roller 522 is arranged between the pair of second link elements 54, that is, arranged substantially at an intermediate position as viewed from the lateral side of the car door 42. Therefore, the stress applied to the second roller 522 from the engaged part 92 is substantially uniformly dissipated to the pair of second link elements 54 via the second member 52.

In the door engagement device 5 of this embodiment, the first member 51 is operably connected to the first member driving mechanism 58 (i.e. the cam mechanism) provided above the car 3 and held at the first position by the first member driving mechanism 58 when the car door 42 is in the fully-closed position (i.e. the door closed state). Further, the first member 51 is held at the second position by the first member driving mechanism 58 when the car door 42 has moved from the fully-closed position (i.e. the door closed state) in the door opening direction. Therefore, the movement of the car door 42 from the fully-closed position (i.e. the door closed state) in the door opening direction allows the first member 51 operably connected to the first member driving mechanism 58 to move from the first position to the second position. Thereby, the first roller 512 is moved toward the second roller 522 side. Accordingly, the first roller 512 and the second roller 522 clamp the engaged part 92 in association with the opening operation of the car door 42, to thereby unlock the landing door 61.

In the door engagement device 5 of this embodiment, the second member 52 is operably connected to the locking mechanism 46 configured to lock or unlock the car door 42 at the fully-closed position (i.e. in the door closed state) and can unlock the locking mechanism 46 when the second member 52 moves from the fourth position to the third position. Therefore, when the car door 42 at the fully-closed position starts its opening operation to cause the engaged part 92 of the landing door 61 to come into contact with the second member 52, the second member 52 moves from the fourth position to the third position, so that the locking mechanism 46 of the car door 42 is unlocked in association with this movement.

The door engagement device 5 of this embodiment includes the engaging part 500 configured to come into clamping engagement with the engaged part 92 and release the clamping engagement by movement of the first roller 512 and the second roller 522 toward and away from each other in the opening and closing direction in association with movement of the first member 51 and the second member 52 toward and away from each other, and is configured to be able to adjust the position of the first roller 512 in the opening and closing direction at which the first roller 512 is held in a clamping engagement with the engaged part 92. As described above, the engaging part 500 (for example, the first engaging part 510 in this embodiment) can adjust the position in the opening and closing direction of at least one roller (i.e., the first roller) 512 of the pair of rollers (i.e., the first roller 512 and the second roller 522), at which position the engaged part 92 is clamped by the first roller 512 and the second roller 522. This configuration enables the fine adjustment of the distance between the engaged part 92 and the first roller 512 of the engaging part 500 by adjusting the position of the first roller 512 (specifically, the first roller body 5127) after the door engagement device 5 is fixed to the car door 42 of the door device 4.

Here, in the case where a door device driven by a different drive system is used in the elevator renewal construction, since such a door device is designed not for the purpose of engagement with the engaged part provided in the opposite door, which already exists before the renewal construction, the associated works for installing a door engagement device in the door of the door device is likely to be complicated. Specifically, it is necessary to fix the door engagement device to the door, while adjusting the position of the door engagement device by moving the entire door engagement device in the opening and closing direction, while preventing interference or collision between a pair of rollers fixed to the members moving toward and away from each other (i.e., the first member and the second member) provided in the door engagement device and the engaged part of the opposite door when the car is raised or lowered. In this position adjustment, strict adjustment of the distance between the rollers and the engaged part must be made in order to reliably prevent the interference of the rollers with the engaged part when the car passes through each landing floor and prevent delay in opening and closing of the opposite door when the door of the door device is opened and closed. However, for such fine adjustment, the entire door engagement device including, for example, the pair of members moving toward and away from each other (i.e., the first member and the second member) to which the rollers are fixed must be moved in the opening and closing direction, which makes the work for installing the door engagement device in the door difficult.

Therefore, the door engagement device 5 of this embodiment having such a configuration that the engaging part 500 can adjust the position of the first roller 512 in the opening and closing direction at which the first roller 512 is held in the clamping engagement position with the engaged part 92 can be more easily installed in the door 42 as compared with the case where the door engagement device is fixed to the car door while adjusting the distance between the rollers and the engaged part by moving the entire door engagement device.

In the door engagement device 5 of this embodiment, the first engaging part 510 of the engaging part 500 includes the first roller support part 511 that is mounted to the first member (one of the members moving toward and away from each other) 51 among the first member 51 and the second member 52 (i.e., a pair of members moving toward and away from each other) and configured to support one roller (i.e. the first roller) 512 of the pair of rollers 512, 522. The first roller support part 511 includes the first plate section 5111 that extends outwardly in the vertical direction and the opening and closing direction and is provided with the first elongated hole 511*a* extending in a direction including a component in the opening and closing direction, while the first roller 512 includes the insertion section 5124 passing through the first elongated hole 511*a* to be movable along the first elongated hole 511*a*. Therefore, the position of the first roller 512 in the opening and closing direction can be easily changed by moving the insertion section 5124 along the first elongated hole 511*a*.

In the door engagement device 5 of this embodiment, the first elongated hole 511*a* extending in the direction inclined to the opening and closing direction can reduce the moving distance of the first roller 512 in the opening and closing direction when the insertion section 5124 has been moved along the first elongated hole 511*a* by the same distance, as compared with an elongated hole extending in the opening and closing direction. This configuration enables the fine adjustment of the position of the first roller 512 in the opening and closing direction more easily.

In the door engagement device 5 of this embodiment, the hole peripheral section 511*b* of the first elongated hole 511*a* in the first plate section 5111 includes a pair of linear edges 511*c* defining the first elongated hole 511 and extending parallel to each other in the inclined direction. Further, the insertion section 5124 includes the pair of sliding surfaces 5125*a* respectively extending along the pair of linear edges 511*c* and configured to be slidable with respect to the pair of linear edges 511*c*. As described above, the edges (i.e., the linear edges) 511*c* of the hole peripheral section 511*b* in contact with the insertion section 5124 a are inclined to the opening and closing direction, so that, even if a force F1 in the opening and closing direction is applied to the first roller 512 when the car door 42 of the door device 4 opens and closes, a component F2 of the force F1 in the direction in which the first elongated hole 511*a* (the pair of linear edges 511*c*) extends is smaller than the force F1 (see FIG. 12). Further, the insertion section 5124 including the pair of sliding surfaces 5125*a* has a large contacting area with the edges of the first elongated hole 511*a* (i.e., the linear edges 511*c* of the hole peripheral section 511*b*) as compared with the case where the insertion section 5124 has a circular column shape. Accordingly, it is possible to effectively suppress the first roller 512 from being displaced in the opening and closing direction, which is caused by the application of the force F1 in the opening and closing direction. Note that a component F3 of the force F1 in the direction orthogonal to the direction in which the first elongated hole 511*a* extends affects the frictional force between the sliding surfaces 5125*a* and the linear edges 511*c* of the first elongated hole 511*a*.

In the door engagement device 5 of this embodiment, the first roller 512 includes the first roller shaft part 5121 extending in the entrance direction and the first roller body 5127 rotatable around the first roller shaft part 5121, and the insertion section 5124 is constituted by a part of the first roller shaft part 5121. As described above, when the insertion section 5124 is formed by utilizing the first roller shaft part 5121 of the first roller 512 to leads to, for example, a simple configuration or a reduced number of parts or members, which enables the reliable stiffness of the insertion section 5124 (i.e., the first roller shaft part 5121). Thereby, it is possible to more favorably suppress the first roller 512 from, for example, being displaced or damaged due to the force in the opening and closing direction applied to the first roller 512.

In the door engagement device 5 of this embodiment, the first roller 512 includes the flange 5123 extending outwardly from one end in the entrance direction (insertion direction) of the insertion section 5124 along the hole peripheral section 511*b* of the first elongated hole 511*a*. The flange 5123 thus being held in surface-to-surface contact with the hole peripheral section 511*b* of the first elongated hole 511*a* allows the first roller 512 to keep its posture with respect to the first plate section 5111 (i.e., in the direction in which the first roller shaft part (rotation axis) 5121 extends) to thereby prevent the first roller 512 from changing its posture with respect to the first plate section 5111 in the position adjustment.

In the door engagement device 5 of this embodiment, the insertion section 5124 includes the male screw 5126 extending from the flange 5123 via the sliding section 5125, and the first roller 512 includes the nut N configured to be brought into threaded engagement with the male screw 5126 to hold the hole peripheral section 511*b* of the first elongated hole 511*a* between the flange 5123 and the nut N. Further, the first plate section 5111 is arranged at a position at which the distance a between the distal end of the insertion section 5124 and the first member 51 (specifically, the first band section 51*a*) is smaller than the dimension in the entrance direction (insertion direction) of the nut N (see FIG. 5). As described above, the configuration that the distance a between the distal end of the insertion section 5124 and the first member 51 is smaller than the dimension of the nut N makes it difficult for the nut N to fall off the insertion section 5124 (i.e., the male screw 5126) when the nut N is loosened. Thereby, the nut N and the first roller 512 are unlikely to fall off when the nut N of the first roller 512 is loosened to adjust the position of the first roller 512 (i.e., during the operation for position adjustment).

In the door engagement device 5 of the first embodiment described above, the parallel link mechanism is configured to allow both of the first member 51 and the second member 52 to be pivotally movable. However, the door engagement device 5 may be configured such that the parallel link mechanism allows at least one of the first member 51 and the second member 52 to be pivotally movable.

Further, any one of the first member 51 and the second member 52 may be fixed (restricted) by, for example, the restricting part 56 so as not to be pivotally movable, while both of the first member 51 and the second member 52 constitute together with the link elements (link members) a parallel link mechanism. A specific description will be given as a second embodiment with reference to FIG. 13 to FIG. 17.

In the same manner as the elevator of the first embodiment, the elevator of the second embodiment is configured to open and close the landing door 61 following the car door 42 when the car door 42 opens and closes when the car 3 lands on a desired landing floor 6.

Figure 13:
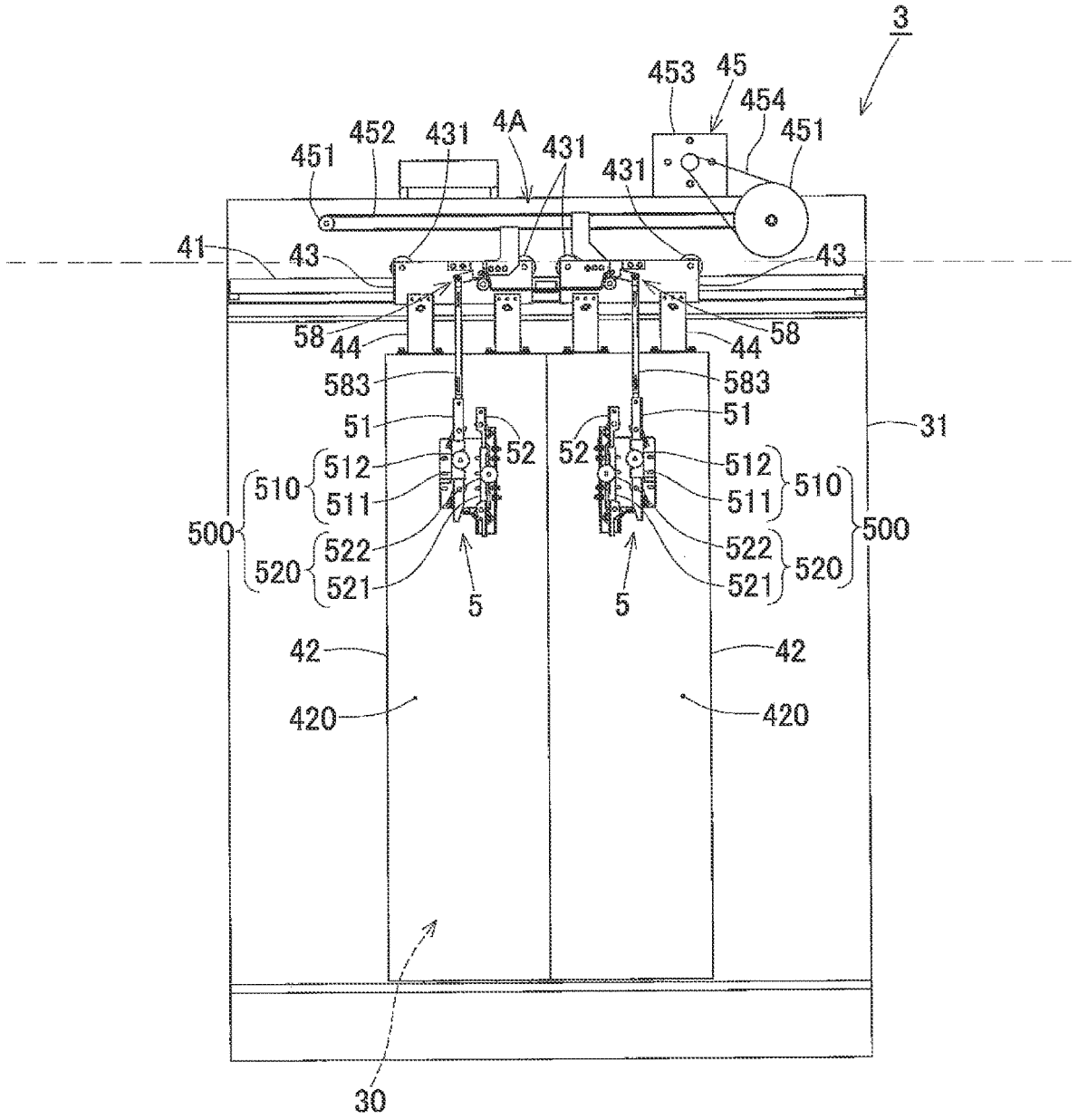
FIG. 13 is a front view of a car of an elevator according to a second embodiment.

As shown in FIG. 13, the car 3 includes the car body 31 having an entrance opening (i.e., the car side entrance) 30, and the door device 4A arranged in the car body 31.

The door device 4A has the same configuration as the door device 4 of the first embodiment except that the door device 4A is not provided with a locking mechanism that can lock the car door 42 and the second member 52 is restricted (fixed) by the restricting part 56.

Figure 14:
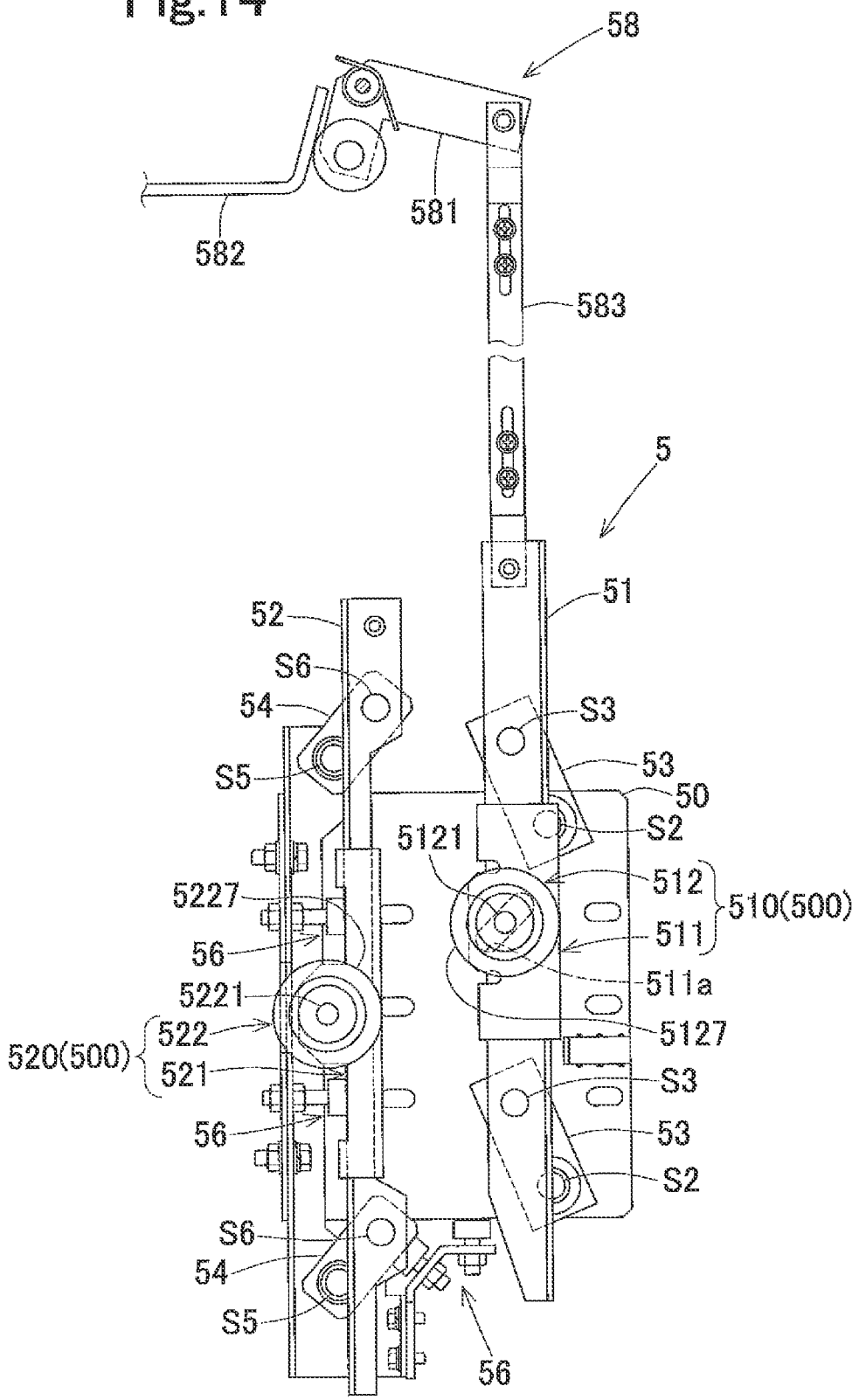
FIG. 14 is an explanatory diagram for the configuration of the door engagement device arranged in a door device for the elevator of the second embodiment.

Specifically, the second member 52 of the door engagement device 5 arranged in the car door 42 is restricted or fixed to a predetermined position (i.e., the fourth position in the first embodiment) by the restricting part 56 as shown in FIG. 14. That is, the second member 52 is fixed so as not to pivotally move (relatively move) with respect to the base 50. The second roller 522 is also fixed to the base 50 accordingly.

In the elevator configured as described above, the door engagement device 5 is configured to transmit the driving force for opening and closing the car door 42 to the landing door 61, to thereby open and close the landing door 61 following the opening and closing the car door 42 in the same manner as the elevator of the first embodiment. A specific description will be given below.

Figure 15:
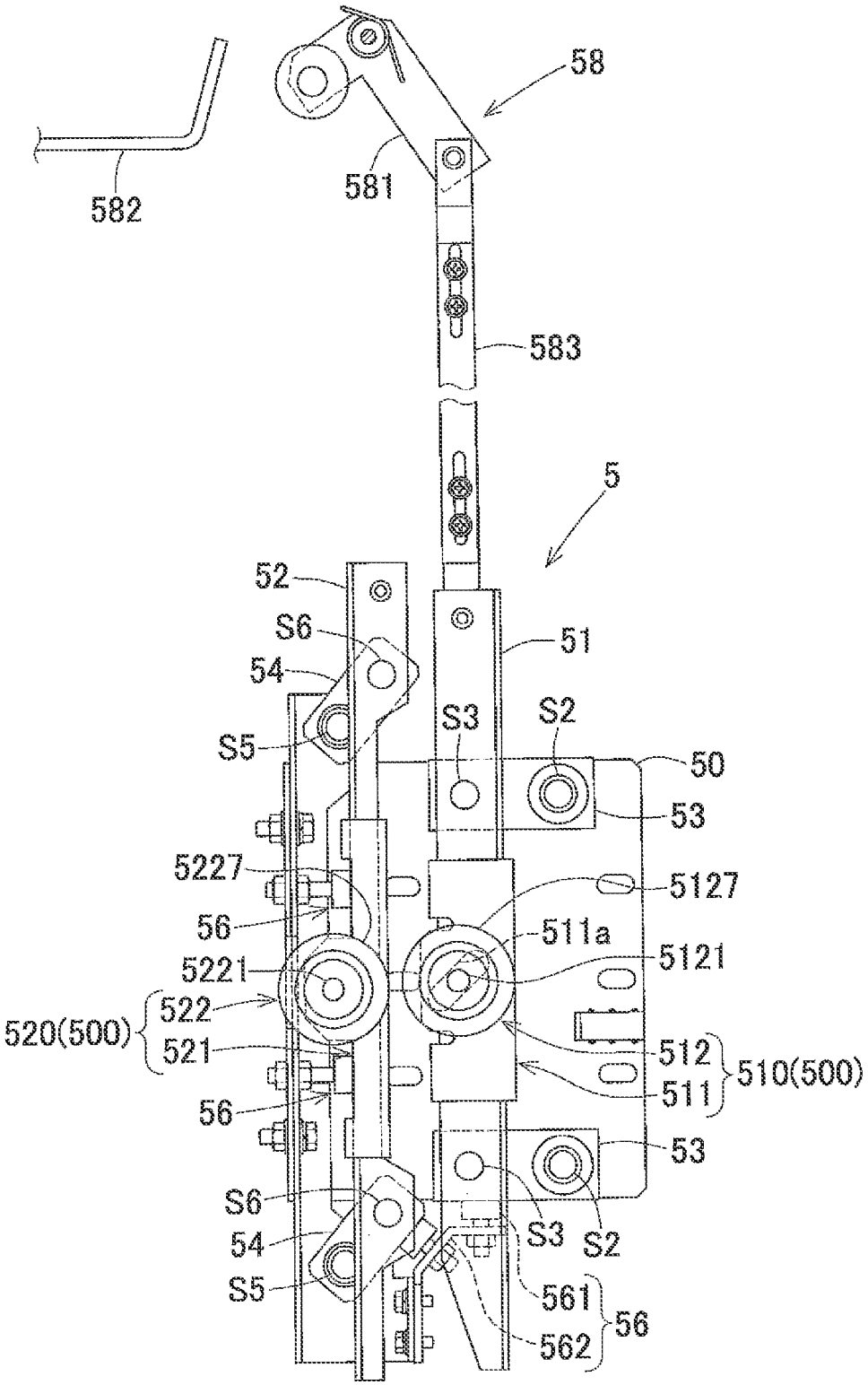
FIG. 15 is an explanatory diagram for the motion of the door engagement device arranged in the door device for the elevator of the second embodiment.
Figure 17:
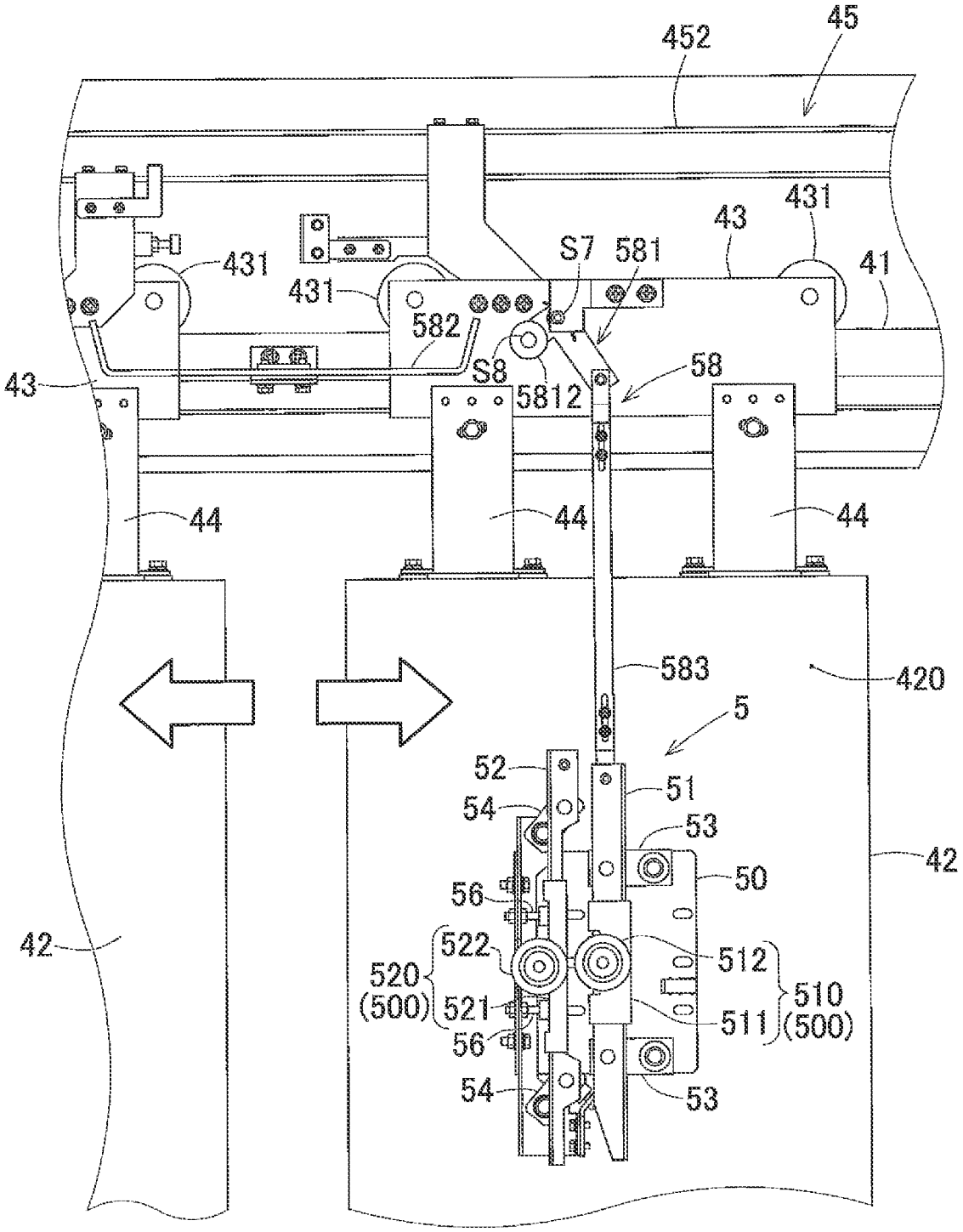
FIG. 17 is an explanatory diagram for the motion of the door engagement device for the elevator of the second embodiment.
Figure 18:
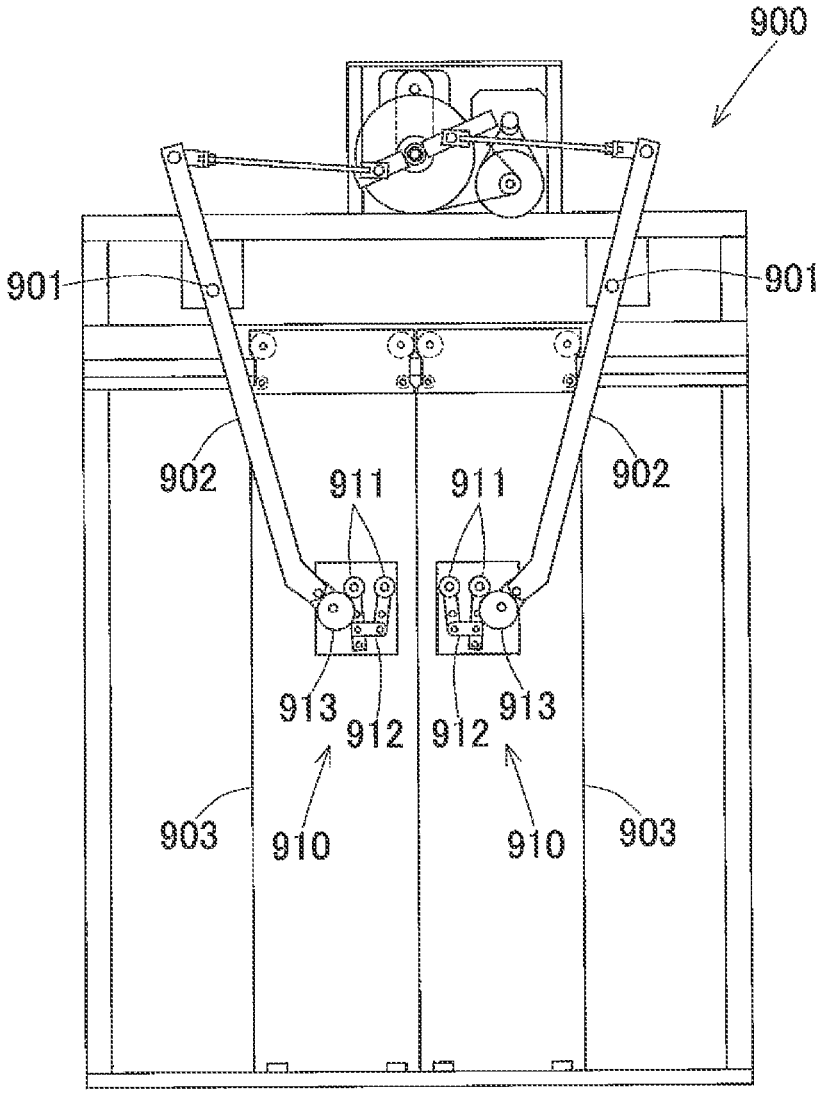
FIG. 18 is a schematic diagram for explaining a conventional door engagement device of the swing arm type.

As shown in FIG. 15 and FIG. 17, when the driving device 45 drives the door hangers 43 to respectively move the two door panels of the car door 42 from the fully-closed position (i.e. the door closed state) in the door opening direction, the first member driving mechanism 58 allows the first member 51 to pivotally move from the first position to the second position on the door closing direction side. The first roller 512 arranged in the first member 51 accordingly comes into contact with the engaged part 92 of the landing door 61 (see the unlock plate 922 and the engaging plate 923 in FIG. 19) to clamp the engaged part 92 in cooperation with the second roller 522. When the car door 42 in this state moves further in the door opening direction, the engaged part 92 is pushed in the door opening direction while being clamped between the first roller 512 and the second roller 522. Thereby, the landing door 61 opens following the car door 42.

Figure 16:
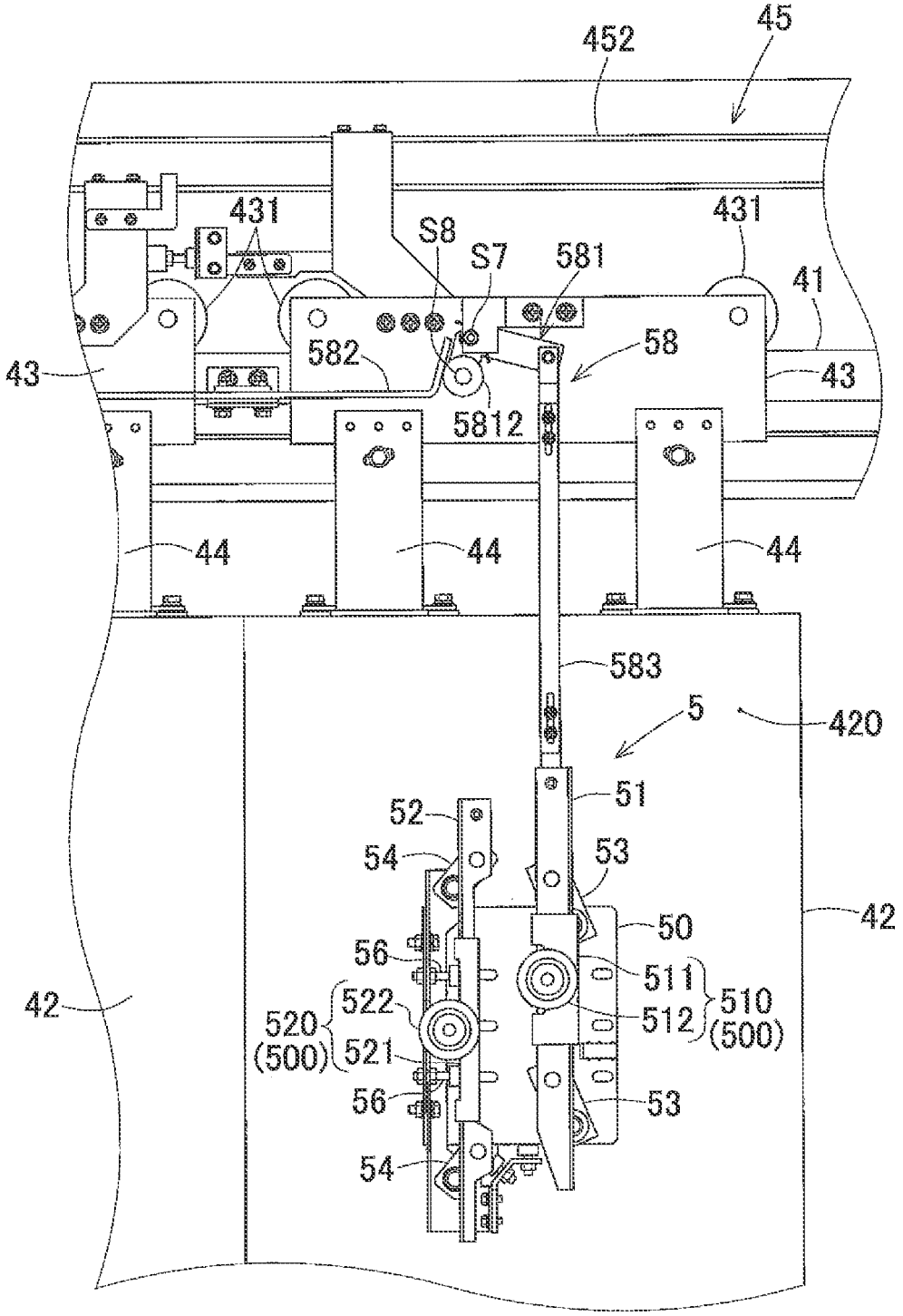
FIG. 16 is an explanatory diagram for the motion of the door engagement device for the elevator of the second embodiment.

On the other hand, in the same manner as the first embodiment as shown in FIG. 14 and FIG. 16, when the doors close, the cam 581 of the first member driving mechanism 58 comes into contact with the cam contact part 582 just before the car door 42 reaches the fully-closed position. Thereby, the first member 51 is pulled upward or pivotally moved upward by the coupling member 583 so that the engaged part 92 is released from the clamped state between the first roller 512 and the second roller 522 to thereby lock the landing door 61. Thereby, the car 3 can be raised or lowered.

Also in the door engagement device 5 of the elevator 1 described above, in the same manner as the first embodiment, the engaging part 500 (i.e., the first engaging part 510) can adjust the position in the opening and closing direction of at least one roller (i.e., the first roller) 512 of the pair of rollers (i.e., the first roller 512 and the second roller 522) located at the clamping engagement position with the engaged part 92. With this, fine adjustment of the distance between the engaged part 92 and the first roller 512 of the engaging part 500 can be made by adjusting the position of the first roller 512 (specifically, the first roller body 5127) after the door engagement device 5 is fixed to the car door 42 of the door device 4A. Thus, the door engagement device 5 can be easily installed in the car door 42 as compared with the case where the door engagement device is fixed to the car door while adjusting the distance between the roller and the engaged part by moving the entire door engagement device.

The elevator door engagement device according to the present invention is not limited to the aforementioned embodiments, and it is a matter of course that various modifications can be made without departing from the gist of the present invention. For example, the configuration of a particular embodiment can be added to the configuration of another embodiment, and a part of the configuration of a particular embodiment can be replaced with the configuration of another embodiment. In addition, a part of the configuration of a particular embodiment can be eliminated.

The door device 4 (i.e. the elevator 1) of the first embodiment and the second embodiment is a so-called center open type door device in which two (a plurality of) door panels of the car door 42 open toward both sides in the width direction of the entrance opening 30, but not limited thereto. The door device 4 (i.e. the elevator 1) may be a so-called single door type door device in which a single door panel of the car door 42 opens toward one side in the width direction of the entrance opening 30.

In the elevator 1 of the first embodiment and the second embodiment, the door engagement device 5 is mounted to each of the two door panels of the car door 42, but not limited thereto. In the case where the engaged part 92 of the landing door 61 is mounted only to one of the two door panels of the landing door 61, the door engagement device 5 may be mounted to the door panel of the car door 42 opposite to the door panel of the landing door 61 with the engaged part 92 arranged therein.

In the elevator 1 of the first embodiment and the second embodiment, the door device 4, 4A including the driving device 45 that drives to open and close the door is arranged in the car 3, but not limited thereto. The door device 4, 4A may be arranged in the landing floor 6. In this case, the door engagement device 5 is arranged in the landing door 61, and the engaged part 92 is arranged in the car door (opposite door) 42.

In the elevator 1 of the first embodiment and the second embodiment, the first engaging part 510 including the first roller 512 is mounted to or arranged in the first member 51, and the second engaging part 520 including the second roller 522 is mounted to or arranged in the second member 52, but not limited thereto. For example, it may be configured such that the engaging part 500 including the first roller 512 and the second roller 522 is mounted to one of the first member 51 and the second member 52, and the engaging part 500 has a mechanism or configuration which causes the first roller 512 and the second roller 522 to move toward or away from each other in the opening and closing direction in association with the first member 51 and the second member 52 moving toward and away from each other.

In the elevator 1 of the first embodiment and the second embodiment, the movement of the insertion section 5124 of the first roller 512 along the elongated hole 511*a* of the first plate section 5111 enables to change or adjust the distance in the opening and closing direction between the first roller 512 and the second roller 522 located at the clamping engagement position with the engaged part 92 (i.e., the position at which the engaged part 92 is clamped), but not limited thereto. It may be configured such that, for example, the first member 51 has a plurality of holes, which are different from each other in the location in the opening and closing direction, and, thereby, the distance in the opening and closing direction of the first roller 512 and the second roller 522 at the clamping engagement position with the engaged part (i.e., the position at which the engaged part is clamped) can be changed or adjusted by changing the hole into which the insertion section 5124 is inserted. That is, any configuration can be adopted as long as the position of the first roller 512 can be changed with respect to the first member 51 in the opening and closing direction and the first roller 512 can be fixed at the changed position.

In the elevator 1 of the first embodiment and the second embodiment, among the pair of rollers 512, 522, only the first roller 512 is configured to be able to change its clamping engagement position in the opening and closing direction (i.e., its position at which the engaged part 92 is clamped by the first roller 512 and the second roller 522), but not limited thereto. Only the second roller 522 may be configured to be able to change its position in the opening and closing direction (i.e., the relative position in the opening and closing direction with respect to the second member 52), or both of the first roller 512 and the second roller 522 may be configured to be able to change their relative positions in the opening and closing direction to the first member or the second member (i.e., the members moving toward and away from each other).

In the elevator 1 of the first embodiment and the second embodiment, the first elongated hole 511*a* extends in the inclined direction to the opening and closing direction, but is not limited thereto. The first elongated hole 511*a* may extend in the opening and closing direction. Even in this case, the sliding section 5125 of the first roller shaft part 5121 having the pair of sliding surfaces 5125*a* can have a large contact area with the pair of linear edges 511*c* of the hole peripheral section 511*b* of the first elongated hole 511*a* as compared with the sliding section having a circular column shape. Thereby, the frictional resistance at the time of sliding of the sliding section 5125 with respect to the linear edges 511*c* is large, and therefore the positional displacement of the first roller 512 due to the application of the force F1 in the opening and closing direction is unlikely to occur. The shape of the sliding section 5125 is not limited to a specific one. For example, the sliding section 5125 may be configured to eliminate a sliding surface.

The first elongated hole 511*a* of the first embodiment and the second embodiment extends in such an inclined direction as to be located more upward as it extends toward the door opening side, but is not limited thereto. The first elongated hole 511*a* may extend in such an inclined direction as to be located more downward as it extends toward the door opening side. Further, the first elongated hole 511*a* may not necessarily extend straight, but may be bent to have a shape such as a circular shape and a wave shape.

In the elevator 1 of the first embodiment and the second embodiment, the insertion section 5124 is constituted by a part of the first roller shaft part 5121, but not limited thereto. The insertion section 5124 may be formed by a separate member or the like from the first roller shaft part 5121 (i.e. the roller engaging section 5122). Further, the first roller 512 may include a plurality of insertion sections 5124 extending in parallel to each other.

In the elevator 1 of the first embodiment and the second embodiment, the first member 51 and the second member 52 move toward and away from each other through the pivotal movement or the swing movement of the link mechanism, but not limited thereto. The first member 51 and the second member 52 (the pair of members moving toward and away from each other) may move toward and away from each other by any mechanism or the like as long as these members are configured to move toward and away from each other in the opening and closing direction in association with the opening and closing of the door 42 of the door device 4, 4A.

Although the elevator door engagement device of this embodiment is as described above, the present invention is not limited to the aforementioned embodiments and the design may be appropriately changed within the scope where the present invention is intended. Also, the functional effect of the present invention is not limited to the aforementioned embodiments. That is, the embodiments disclosed herein should be assumed as not limitations but exemplifications in all aspects. The scope of the present invention is described not by the above description but by the claims. Further, the scope of the present invention is intended to include the scope equivalent to the claims and all the changes in the claims.

What is claimed is:

1. An elevator door engagement device provided in one of a car door and a landing door and configured to engage with an engaged part provided in the remaining one of the landing door and the car door to transmit driving force to open and close the one of the car door and the landing door to the remaining one of the landing door and the car door, the engagement device comprising:

a first member extending in a vertical direction;

a second member extending in the vertical direction and arranged at a position with a distance from the first member to be closer to a door closing side than the first member;

at least one of a first link member and a second link member, the first link member constituting together with the first member a parallel link mechanism configured to enable the first member to be pivotally movable between a first position that is a given position and a second position that is a position closer to the door closing side than the first position while the posture of the first member to the second member is maintained, the second link member constituting together with the second member a parallel link mechanism configured to enable the second member to be pivotally movable between a third position that is a given position and a forth position that is a position closer to a door opening side than the third position while the posture of the second member to the first member is maintained;

a first roller arranged in the first member to have its circumference facing the engaged part when the car lands on a given landing floor; and a second roller arranged in the second member to have its circumference facing the engaged part when the car lands on the given landing floor.

2. The elevator door engagement device according to claim 1, wherein the first link member comprises a pair of first link elements, and the first roller is arranged between the pair of first link elements as viewed from a lateral side of the car door or the landing door.

3. The elevator door engagement device according to claim 1, wherein the second link member comprises a pair of second link elements, and the second roller is arranged between the pair of second link elements as viewed from a lateral side of the car door or the landing door.

4. The elevator door engagement device according to claim 1, wherein the first member is operably connected to a cam mechanism provided above an entrance on a car side or a landing floor side to allow the cam mechanism to hold the first member at the first position in a door closed state and hold the first member at the second position when the car door or the landing door has moved from the door closed state in a door opening direction.

5. The elevator door engagement device according to claim 1, wherein the second member is operably connected to a locking mechanism configured to lock or unlock the car door or the landing door in the door closed state, and unlocks the locking mechanism when the second member moves from the fourth position to the third position.

6. The elevator door engagement device according to claim 1, further comprising an engaging part comprising the first roller and the second roller configured to come into clamping engagement with the engaged part and release the clamping engagement by movement of the first roller and the second roller toward and away from each other in the opening and closing direction of the car door or the landing door in association with movement of the first member and the second member toward and away from each other, the engaging part being configured to be able to adjust the position in the opening and closing direction of at least one of the first roller and the second roller, at which position the engaged part is clamped by the first roller and the second roller.

7. The elevator door engagement device according to claim 6, wherein the engaging part comprises a roller support part that is mounted to one of the first member and the second member and configured to support the one of the first roller and the second roller, the roller support part comprises a plate section that extends outward in the vertical direction and the opening and closing direction and is provided with an elongated hole extending in a direction including a component in the opening and closing direction, and the one of the first roller and the second roller comprises an insertion section passing through the elongated hole to be movable along the elongated hole.

8. The elevator door engagement device according to claim 7, wherein the elongated hole extends in a direction inclined to the opening and closing direction.

9. The elevator door engagement device according to claim 8, wherein the plate section comprises a hole peripheral section of the elongated hole, the elongated hole being defined by a pair of edges and extending in the inclined direction in parallel to each other, and the insertion section comprises a pair of sliding surfaces respectively extending along the pair of edges to be slidable with respect to the pair of edges.

10. The elevator door engagement device according to claim 7, wherein the one of the first roller and the second roller comprises a shaft extending in an entrance direction of the car, and a roller body rotatable around the shaft, and the insert section is constituted by a part of the shaft.

11. The elevator door engagement device according to claim 7, wherein the one of the first roller and the second roller comprises a flange extending outward from one end in an insertion direction of the insertion section along the hole peripheral section of the elongated hole.

12. The elevator door engagement device according to claim 11, wherein the insertion section comprises a male screw extending directly or indirectly from the flange, the one of the first roller and the second roller comprises a nut configured to be brought into threaded engagement with the male screw to hold the hole peripheral section between the flange and the nut, and the plate section is arranged at a position at which a distance between a distal end of the insertion section and one of the first member and the second member is smaller than a dimension in the insertion direction of the nut.

* * * * *